US008006734B2

(12) United States Patent
Hajny et al.

(10) Patent No.: US 8,006,734 B2
(45) Date of Patent: Aug. 30, 2011

(54) SYSTEM AND METHOD FOR ADVANCING THERMOPLASTIC ADHESIVE SEGMENT DISPENSING TAPE AND APPLYING ADHESIVE SEGMENTS THEREBY

(75) Inventors: Roger V. Hajny, Cedarburg, WI (US); Burton J. Peterson, Waterford, WI (US); Dennis P. Tronca, Mequon, WI (US)

(73) Assignee: Glue Dots International LLC, New Berlin, WI (US)

( * ) Notice: Subject to any disclaimer, the term of this patent is extended or adjusted under 35 U.S.C. 154(b) by 721 days.

(21) Appl. No.: 10/944,535

(22) Filed: Sep. 17, 2004

(65) Prior Publication Data

US 2005/0178507 A1 Aug. 18, 2005

Related U.S. Application Data

(60) Provisional application No. 60/528,243, filed on Dec. 9, 2003.

(51) Int. Cl.
*B32B 15/00* (2006.01)

(52) U.S. Cl. ..... 156/538; 156/578; 156/579; 242/588.3

(58) Field of Classification Search ..... 156/538, 156/578, 579; 242/588.3
See application file for complete search history.

(56) References Cited

U.S. PATENT DOCUMENTS

| | | | |
|---|---|---|---|
| 2,276,297 | A | 12/1938 | Flood |
| 2,373,062 | A | 4/1945 | Avery |
| 2,647,843 | A | 3/1950 | Bemmels |
| 2,764,694 | A | 7/1956 | Cole |
| 2,838,171 | A | 6/1958 | Kaspar |
| 2,879,547 | A | 3/1959 | Morris |
| 2,912,140 | A | 11/1959 | Cole |
| 3,066,881 | A | 12/1962 | Krueger |
| 3,225,916 | A | 12/1965 | Field et al. |
| 3,239,403 | A | 3/1966 | Williams et al. |
| 3,267,623 | A | 8/1966 | Block |
| 3,308,002 | A | 3/1967 | Bremer et al. |
| 3,445,263 | A | 5/1969 | Alexander |
| 3,457,919 | A | 7/1969 | Harbard |
| 3,464,883 | A | 9/1969 | Moline et al. |
| 3,567,148 | A | 3/1971 | Ottavan |

(Continued)

FOREIGN PATENT DOCUMENTS

DE 2362897 A * 6/1975

(Continued)

OTHER PUBLICATIONS

Statement by Applicant in Compliance with 37 C.F.R. § 1.56, dated Oct. 11, 2005.

*Primary Examiner* — Philip Tucker
*Assistant Examiner* — Kimberly K McClelland
(74) *Attorney, Agent, or Firm* — Reinhart Boerner Van Deuren s.c.

(57) ABSTRACT

An adhesive segment applicator apparatus is provided for use with an adhesive segment laden carrier release tape. The adhesive segment applicator has an adhesive dispensing wheel upon which a roll of adhesive segment carrier release tape is mounted and a take-up core system that prevents the adhesive segment-laden carrier release tape from becoming loose or pulling away from the adhesive segment applicator apparatus when an adhesive segment is dispensed, in order easily to dispense an adhesive segment to a surface.

8 Claims, 12 Drawing Sheets

U.S. PATENT DOCUMENTS

| | | | | |
|---|---|---|---|---|
| 3,582,438 | A | | 6/1971 | Harbour |
| 3,595,204 | A | | 7/1971 | McIntyre et al. |
| 3,619,324 | A | | 11/1971 | Sato et al. |
| 3,736,281 | A | | 5/1973 | Russell |
| 3,741,486 | A | | 6/1973 | Kawamatu |
| 3,741,786 | A | | 6/1973 | Torrey |
| 3,877,959 | A | | 4/1975 | Weiss |
| 3,881,041 | A | | 4/1975 | Glienke |
| 3,932,326 | A | | 1/1976 | Hoh |
| 3,932,328 | A | | 1/1976 | Korpman |
| 3,956,223 | A | | 5/1976 | Chiang |
| 3,969,181 | A | | 7/1976 | Seabold |
| 3,997,702 | A | | 12/1976 | Schurb et al. |
| 4,002,794 | A | | 1/1977 | Schwarcz |
| 4,100,852 | A | | 7/1978 | Hamisch, Jr. |
| 4,116,746 | A | | 9/1978 | Hamisch, Jr. |
| 4,211,805 | A | | 7/1980 | Chamberlin |
| 4,272,311 | A | | 6/1981 | D'Angelo et al. |
| 4,294,357 | A | | 10/1981 | Stevens et al. |
| 4,387,831 | A | | 6/1983 | McNally |
| 4,440,830 | A | | 4/1984 | Wempe |
| 4,452,667 | A | | 6/1984 | Chang |
| 4,470,864 | A | | 9/1984 | Haden et al. |
| 4,508,588 | A | | 4/1985 | Parrish |
| 4,537,934 | A | | 8/1985 | Fock et al. |
| 4,543,099 | A | | 9/1985 | Bunnelle et al. |
| 4,560,087 | A | | 12/1985 | Sato et al. |
| 4,562,102 | A | | 12/1985 | Rabuse et al. |
| 4,699,685 | A | | 10/1987 | Sato |
| 4,718,971 | A | | 1/1988 | Summers |
| 4,719,261 | A | | 1/1988 | Bunnelle et al. |
| 4,731,066 | A | | 3/1988 | Korpman |
| 4,804,437 | A | | 2/1989 | Tirtoprodjo et al. |
| 4,820,446 | A | | 4/1989 | Prud'Homme |
| 4,822,687 | A | | 4/1989 | Kessel et al. |
| 4,846,924 | A | | 7/1989 | Morrison |
| 4,851,074 | A | | 7/1989 | Hiromichi |
| 4,851,278 | A | | 7/1989 | Enanoza |
| 4,959,008 | A | | 9/1990 | Wasulko |
| 4,961,804 | A | | 10/1990 | Aurichio |
| 4,965,113 | A | | 10/1990 | Jones et al. |
| 4,977,006 | A | | 12/1990 | Smith et al. |
| 4,985,499 | A | | 1/1991 | Nichikawa et al. |
| 5,045,145 | A | | 9/1991 | Becker |
| 5,049,434 | A | | 9/1991 | Wasulko |
| 5,133,827 | A | | 7/1992 | Ratermann |
| 5,158,818 | A | | 10/1992 | Aurichio |
| 5,202,169 | A | | 4/1993 | Spendlove |
| 5,254,206 | A | | 10/1993 | Wing |
| 5,316,613 | A | | 5/1994 | Samuelson et al. |
| 5,344,681 | A | | 9/1994 | Calhoun et al. |
| 5,456,792 | A | | 10/1995 | Rodriguez et al. |
| 5,486,389 | A | * | 1/1996 | Gerber ..... 428/41.9 |
| 5,489,453 | A | | 2/1996 | Friesch |
| 5,499,877 | A | * | 3/1996 | Sakanishi et al. ..... 400/193 |
| 5,575,097 | A | | 11/1996 | Chou et al. |
| 5,575,202 | A | | 11/1996 | Pfeiffer |
| 5,683,545 | A | | 11/1997 | Goodwin et al. |
| 5,685,944 | A | | 11/1997 | Nose et al. |
| 5,738,755 | A | | 4/1998 | Hartman |
| 5,779,852 | A | | 7/1998 | Haney et al. |
| 5,875,715 | A | | 3/1999 | Hamisch, Jr. et al. |
| 5,906,443 | A | | 5/1999 | Goodwin et al. |
| 5,910,227 | A | | 6/1999 | Mistyurik et al. |
| 5,934,189 | A | | 8/1999 | Mistyurik et al. |
| 5,935,670 | A | | 8/1999 | Downs |
| 5,988,249 | A | | 11/1999 | Mistyurik et al. |
| 6,102,098 | A | | 8/2000 | Randazzo |
| 6,143,105 | A | | 11/2000 | Nash et al. |
| 6,171,439 | B1 | | 1/2001 | Groeneweg |
| 6,206,072 | B1 | | 3/2001 | Orihara et al. |
| 6,230,780 | B1 | | 5/2001 | Rietheimer |
| 6,280,565 | B1 | | 8/2001 | Underwood |
| 6,319,442 | B1 | | 11/2001 | Downs |
| 6,363,990 | B1 | | 4/2002 | Kozaki |
| 6,433,055 | B1 | | 8/2002 | Kleyer et al. |
| 6,439,289 | B1 | | 8/2002 | Schlotthauer |
| 6,527,888 | B2 | | 3/2003 | Williams et al. |
| 6,634,400 | B2 | | 10/2003 | Barbosa |
| 6,640,864 | B2 | | 11/2003 | Downs |
| 6,686,016 | B2 | | 2/2004 | Downs |
| 2002/0059984 | A1 | | 5/2002 | Goodwin et al. |
| 2003/0056869 | A1 | | 3/2003 | Tate et al. |
| 2003/0084987 | A1 | | 5/2003 | Rodriguez et al. |
| 2003/0116284 | A1 | | 6/2003 | Downs et al. |
| 2004/0151861 | A1 | | 8/2004 | Downs |
| 2004/0219332 | A1 | | 11/2004 | Dean et al. |

FOREIGN PATENT DOCUMENTS

| | | | |
|---|---|---|---|
| DE | 4319023 | C1 | 9/1994 |
| DE | 4319023 | C1 | 9/1994 |
| DE | 20210691 | U1 | 9/2002 |
| DE | 20210691 | U1 | 9/2002 |
| EP | 0609826 | A | 8/1994 |
| EP | 0609826 | A | 8/1994 |
| EP | 0619189 | A2 | 10/1994 |
| EP | 0619189 | A2 | 10/1994 |
| EP | 0619189 | A3 | 10/1994 |
| EP | 0619189 | A3 | 10/1994 |
| EP | 1233046 | A | 8/2002 |
| EP | 1445226 | A3 | 9/2004 |
| EP | 1541514 | A | 6/2005 |
| GB | 681096 | | 10/1952 |
| GB | 780291 | | 7/1957 |
| GB | 936447 | | 9/1963 |
| GB | 936448 | | 9/1963 |
| GB | 978566 | | 12/1964 |
| GB | 1404925 | | 9/1975 |
| GB | 2208825 | | 4/1989 |
| GB | 2361442 | | 10/2001 |
| GB | 2397258 | A | 7/2004 |
| GB | 2397258 | A | 7/2004 |
| JP | 2011684 | | 1/1990 |
| JP | 10007310 | A | 1/1998 |
| JP | 2001 018586 | A | 1/2001 |
| WO | WO92/19447 | | 11/1992 |
| WO | WO 2006054895 | A | 5/2006 |

* cited by examiner

SYSTEM AND METHOD FOR ADVANCING THERMOPLASTIC ADHESIVE SEGMENT DISPENSING TAPE AND APPLYING ADHESIVE SEGMENTS THEREBY

Application claims the benefit of U.S. Provisional Patent Application No. 60/528,243, filed on Dec. 9, 2003.

BACKGROUND OF THE INVENTION

Field of the Invention

The present invention relates generally to pressure-sensitive adhesives and their application to desired surfaces, and, specifically, to an adhesive segment applicator apparatus used with rolls of carrier release tape having pressure-sensitive adhesive segments attached thereto which may be advanced and dispensed by the adhesive segment applicator apparatus of the present invention.

Adhesives are more than just substances serving to hold materials together by surface attachment. The term "adhesive" is simplistic and explains little, but generically describes a class of "sticky" materials. Adhesives and adhesive applicators owe their innovation to the Industrial Revolution, which resulted in an explosion of technical and scientific breakthroughs. The breakthroughs of the Industrial Revolution included the introduction of new materials and ingredients for use in formulating market-specific and industry-specific adhesives. In creating novel adhesives, companies have diligently considered desirable qualities such as adhesive flexibility, toughness, minimum curing or setting time, and temperature and chemical resistance. Today, the technology and underlying science of adhesives and apparatuses for their application is the foundation for a multi-billion dollar industry with over 700 companies competing for market share. More importantly, these companies strive to create and introduce novel adhesives as well as apparatuses and methods for the simple, efficient, inexpensive, and safe application of adhesives.

One of the most significant adhesive technical breakthroughs of the past century has been the introduction of pressure-sensitive thermoplastic adhesives. Thermoplastic adhesives have excellent adhering qualities; they can be softened by heating and firmed by cooling. These characteristics help thermoplastic adhesives produce waterproof, resilient, and long-lasting flexible bonds. Thermoplastic adhesives have what is known as a "plastic memory," meaning that each time a thermoplastic adhesive is heated, it can be molded into any desired form.

Thermoplastic adhesives have significant applications in today's industry. For example, in the preparation of mass mailings, marketers often desire to attach a card, such as a credit card or the like, to a carrier document so that a consumer can peel the card easily from the carrier document. One method of making such an attachment involves the use of a pressure-sensitive, thermoplastic adhesive. For example, by using a heating container to melt thermoplastic adhesive and a metering pump to dispense it during the printing or collating process, a portion of thermoplastic adhesive can be metered onto the carrier document and the credit card pressed against it.

In addition to the uses for thermoplastic adhesives described above, industry is now finding additional uses for them. For example, thermoplastic adhesives are routinely used and applied as small bond points to eliminate the use of mechanical fasteners, such as staples, screws, rivets, clips, snaps, nails, and stitching. Thermoplastic adhesives are also extensively used in the packaging and manufacture of cartons, boxes and corrugated boards, bags, envelopes, disposable products (diapers and other paper products), cigarettes, labels, and stamps. In fact, today's demand for thermoplastic adhesives extends to very broad fields of use and is not limited to assembly line-like settings.

Increasingly, industry demands thermoplastic adhesive application at on-site locations from portable, simple-to-use, efficient, inexpensive, and safe dispensing apparatuses. Additionally, such dispensing apparatuses must be able to adhere thermoplastic adhesives to non-planar, recessed, difficult to reach, or unstable surfaces. Previously known apparatuses and methods have failed to provide an adequate portable, simple-to-use, efficient, inexpensive, and safe dispensing device and a thermoplastic adhesive carrying medium capable of applying thermoplastic adhesives to non-planar, recessed, difficult to reach, or unstable surfaces.

In providing thermoplastic adhesives for application to a surface, the previously known embodiments have contemplated all of the following thermoplastic adhesive carrying media and application methods: hot-melt "glue-gun" adhesive dispensers; adhesive segment-laden carrier release tape for "by hand" adhesive application; use of a plunger-like dispensing system in combination with adhesive segment-laden carrier release tape, which proves to be cumbersome and which has a limited utility of application to planar surfaces; use of a cardboard box applicator system for use in combination with adhesive segment-laden carrier release tape, which is also limited in application to planar, non-recessed surfaces; and an electric automated dispensing system for use with adhesive segment-laden carrier release tape, which is activated by the pressing of a palm-sized push button, and which also only allows for application of thermoplastic adhesives to unobstructed planar surfaces.

Using a "glue gun" device is an inefficient, difficult, and at times unsafe method of applying thermoplastic adhesives to a desired surface. First, the cost of using this equipment is relatively high. The apparatus and method are also inefficient consumers of both energy and glue. Specifically, the costs of the activation of such a dispenser (electrical usage, wasted glue from droppings) for only short periods of time outweigh any other potential advantages which may be realized.

Safety is also an issue. Glue-gun devices are potentially unsafe because they include a heat source to heat a quantifiable supply of adhesive material to its melting point. A major drawback of using such an instrument is that the hot, molten thermoplastic adhesive can burn untrained users, and can also melt the substrate the user is applying the glue to. Finally, application of thermoplastic adhesives from a glue-gun does not enable the thermoplastic adhesive to withstand cold temperatures or to cool to a smooth surface, but instead will typically leave "spider webs" in the dried adhesive. In short, glue-gun applicators of the prior art are inefficient, difficult, and unsafe.

Many of the shortcomings of the glue-gun instruments of the prior art were solved by U.S. Pat. No. 5,935,670 to Downs (the "'670 patent"), which patent is hereby incorporated herein by reference. However, upon further use of the technology of the '670 patent, several shortcomings have become apparent. Specifically, while the '670 patent discloses a method for presenting cooled adhesive segments for application to a desired surface, the application of the segments to the surface proves to be very inefficient.

The technology of the '670 patent focuses mainly on the manufacture of a clean, unaltered carrier release tape having first and second release surfaces with different release properties, and the application thereto of adhesive segments at periodic intervals. The adhesive segment-laden carrier release tape is then wound into a roll. This embodiment allows a user to apply the adhesive segments from the carrier release tape by hand. Although such an embodiment provides a highly innovative and commercially successful product, application of the adhesive segments remains inefficient and cumbersome.

Specifically, the coiled adhesive segment-laden carrier release tape must be unrolled to present an adhesive segment for application. After the adhesive segment has been applied to the desired surface, the tape must be unrolled an additional distance to ready the next adhesive segment for application. Such a method is time-consuming, and the "spent" carrier release tape must be either torn off and disposed of or left intact and in the way. Finally, dropping or uncoiling the unused roll of adhesive segment-laden carrier release tape has also been a problem.

U.S. Pat. No. 6,319,442 to Downs (the "'442 patent"), which patent is hereby incorporated herein by reference, further evolved the previously known adhesive segment-laden carrier release tape of the '670 patent. Like the '670 patent, the '442 patent also contemplates a carrier release tape, which has first and second release surfaces with different release properties, and the application thereto of adhesive segments at periodic intervals. But unlike the '670 patent, the '442 patent contemplates a thermoplastic adhesive carrier release tape having a transverse line of slits or perforations precut across its transverse width and between the adhesive segments.

The precut tape of the '442 patent thus allows individual portions of the carrier release tape and associated thermoplastic adhesive to be removed from the roll for manual application to a desired surface. While such an embodiment remedies the '670 patent's problem of having a length of uncut spent carrier release tape, the carrier release tape of the '442 patent (as well as of the '670 patent) does not lend itself to use in combination with a more efficient dispenser for application of the adhesive segments to non-planar, recessed, difficult to reach, or unstable surfaces.

While the '670 and '442 patents focus primarily on the creation of adhesive segment-laden carrier release tape, they also contemplate use of the adhesive segment-laden carrier release tape in combination with numerous dispenser apparatuses. First, a plunger-like applicator, as detailed within both the '670 and '442 patents, proves manageable, but is limited in the type of surfaces that the thermoplastic adhesive may be applied to. Specifically, because the plunger mechanism has an attached planar foot portion, which is used to guide the placement of the adhesive segments, application of the thermoplastic adhesive segments is essentially confined to an unobstructed flat surface. Such a limitation can pose significant problems when attempting to apply thermoplastic adhesives to non-flat surfaces. It may be more practical to use the above "by hand" manual method of thermoplastic adhesive application.

Another previously known thermoplastic adhesive applicator that presents some apparent problems is the so-called box applicator. This applicator is also limited in thermoplastic adhesive application to planar surfaces. The box applicator encases a roll of adhesive segment-laden carrier release tape as disclosed within the '670 and '442 patents. When the carrier release tape is advanced from the box applicator by hand, the thermoplastic adhesive can only be applied to surfaces that are of a generally planar nature.

The adhesive segments must be pressed between the surface to be glued and the top of the cardboard box applicator to ensure adherence. This application process exposes unspent adhesive segments to dust and other debris, which may cause the adhesive segments to lose their adhesive tack and damage or soil the desired surface. Additionally, because the cardboard box thermoplastic adhesive applicator must be of a certain size to house a spool of carrier release tape, application of adhesive segments to areas that are non-flat or recessed proves to be difficult, if not impossible.

While not all previously known thermoplastic adhesive applicators are manual, even applicators that are automated present problems. For example, while automated thermoplastic adhesive applicators are more efficient than the box applicator described above, they are also more expensive. The previously known automated methods dispose of the need to manually advance the carrier release tape, but are one-of-a-kind units and thus represent a very expensive option for both the adhesive manufacturer and the end user. Automated thermoplastic adhesive applicators are also limited to thermoplastic adhesive application to generally planar surfaces. In short, their limitations are similar to those of the previously known embodiments presented above because, due to their size, they may not be positioned for the application of thermoplastic adhesive into recessed areas or onto generally non-flat surfaces.

In order to overcome the drawbacks of the aforementioned apparatuses and methods, a "gun-type" adhesive segment application apparatus capable of advancing and dispensing adhesive segments from an adhesive segment-laden carrier release tape was developed. (Examples of such "gun-type" adhesive segment application devices are disclosed in U.S. patent application Ser. No. 10/360,395 by Downs et al. filed Feb. 8, 2003, and U.S. patent application Ser. No. 10/368,231 by Downs et al. filed Feb. 18, 2003).

Such an adhesive segment application apparatus contains a drive mechanism for engaging an indexing instrumentality on the adhesive segment-laden carrier release tape to allow it to dispense adhesive segments, thereby solving the problems of prior art adhesive tape dispensing apparatuses. In addition, such an adhesive segment applicator apparatus is capable of applying adhesive segments to non-flat, recessed, difficult to reach, or unstable surfaces in a simple, efficient, safe, and automatic manner.

However, the aforementioned devices contain several drawbacks. First, the carrier tape tends to become loose and pulls away from the nose of the adhesive segment applicator apparatus or comes out of the applicator apparatus. When the carrier tape becomes loose, the adhesive segment is not easily applied to the intended surface. However, simply increasing the tension of the carrier tape impedes advancement of the carrier tape, and thus, causes problems in efficiency and automation of the application process.

In addition, the aforementioned adhesive segment applicator apparatus discharges spent carrier release tape which is cumbersome and awkward to deal with during a continuous operation. The spent carrier release tape can get in the way of processing and can require interference in application operations when disposal of the spent carrier release tape is necessary.

Accordingly, it is the primary objective of the present invention to provide an adhesive segment applicator apparatus capable of dispensing adhesive segments from an adhesive segment-laden carrier release tape in which an adhesive segment is easily applied to a surface without the release tape coming out of the applicator apparatus. It is therefore a related objective of the present invention that the adhesive segment applicator apparatus provide the adhesive segment-laden carrier release tape with sufficient tension to dispense an adhesive segment without the carrier release tape pulling away from the nose of the adhesive segment applicator apparatus. It is a related objective of the present invention to provide the ability to easily and readily advance the adhesive segment-laden carrier release tape, exposing the next adhesive segment on the carrier release tape.

It is an additional objective of the present invention to provide an adhesive segment applicator apparatus in which the adhesive segment-laden carrier release tape advances to dispense an adhesive segment and which automatically winds spent tape onto a take-up core, thereby permitting adhesive segments to be dispensed while automatically advancing adhesive segment-laden carrier release tape to expose another adhesive segment to a surface. Thus, it is a related objective of the present invention to provide in a first embodiment an automatic advancing adhesive segment applicator apparatus that dispenses an adhesive segment and advances the adhesive segment-laden carrier release tape to the next adhesive segment on the tape without the need for an internal actuator or trigger release.

It is another objective of the present invention that in other embodiments the adhesive segment applicator apparatus have a drive mechanism for engaging an indexing instrumentality on an adhesive segment-laden carrier release tape. It is a related objective of a second embodiment of the present invention to provide an adhesive segment applicator apparatus for use as a hand-held "gun type" adhesive segment applicator apparatus including a manual actuating mechanism such as a trigger system to advance the adhesive segment-laden carrier release tape to expose the next consecutive adhesive segment to a surface. It is yet another object of a third embodiment of the present invention to provide an adhesive segment applicator apparatus for use in industrial or high-throughput applications that includes a powered actuating mechanism to advance the adhesive segment-laden carrier release tape to expose an adhesive segment to a surface.

Each implementation of the adhesive segment applicator apparatus of the present invention must also be of construction which is both durable and long lasting, and they should also require little or no maintenance to be provided by the user throughout its operating lifetime. In order to enhance the market appeal of the adhesive segment applicator apparatuses of the present invention, they should also be of inexpensive construction to thereby afford them the broadest possible market. Finally, all of the aforesaid advantages and objectives of the adhesive segment applicator apparatuses of the present invention are achieved without incurring any substantial relative disadvantage.

SUMMARY OF THE INVENTION

The disadvantages and limitations of the background art discussed above are overcome by the present invention. With this invention, an adhesive segment applicator apparatus is provided having an adhesive dispensing wheel and a take-up core system that prevents the adhesive segment-laden carrier release tape from becoming loose or pulling away from the adhesive segment applicator apparatus when an adhesive segment is dispensed, in order to easily dispense an adhesive segment to a surface. The adhesive segment applicator apparatus of the present invention provides a manner of applying adhesive segment-laden carrier release tape to non-flat, recessed, difficult to reach, or unstable surfaces.

The carrier release tape used in the present invention is flexible, extends longitudinally, and in the preferred embodiment can have a transverse width of approximately one inch. Additionally, it has opposed first and second release surfaces which have different release properties. Adhesive segments are arrayed generally longitudinally along the first release surface of the carrier release tape (although they instead may be staggered if desired). While the adhesive segments are preferably circular, they may instead be of other different shapes and configurations including, but not limited to, squares, triangles, ovals, dots, other geometric figures, caricature shapes, and the like.

The carrier release tape may be made from plain stock carrier release tape, which can be cut into individual tape strips either before or after the adhesive segment application processes. The transverse width of the preferred embodiment is approximately one inch although the dimensions of the carrier release tape strips may vary in accordance with the advancement mechanism associated with the adhesive segment applicator apparatus of the present invention with which it is used.

The second surface of the carrier release tape has a release property different from that of the first so that adhesive segments do not adhere to the second surface as strongly as they do to the first surface. When the carrier release tape is wound into rolls, the first surface, and thus, the adhesive segments applied thereto, will be the external surface of the roll of adhesive segment-laden carrier release tape.

In certain embodiments of the present invention, the carrier release tape includes an indexing instrumentality. The indexing instrumentality consists of a plurality of patterned scores, cuts, or indentations located in the surface of the carrier release tape, thereby allowing for an advancement mechanism to protrude therethrough. Adhesive segments may be pre-metered onto the carrier release tape before indexing occurs, or the indexing may occur first and the adhesive may be applied thereafter.

A first embodiment of an adhesive segment applicator apparatus of the present invention contains a carrier tape dispensing system and an adhesive dispensing wheel. The carrier tape dispensing system includes a supply spool that is rotatably mounted inside the housing of the adhesive segment applicator apparatus. A roll of adhesive segment-laden carrier release tape is inserted onto the supply spool and engages the supply spool in a secure fashion, permitting the roll of adhesive segment-laden carrier release tape to rotate when the supply spool rotates. The supply spool has a drive pulley mounted thereon in order to drive a belt, as will become evident.

The carrier tape dispensing system also includes a take-up spool that is rotatably mounted inside the housing of the adhesive segment applicator apparatus. The take-up spool is configured to permit a spent carrier tape take-up core to be inserted and securely fastened thereon. The take-up core is inserted onto the take-up spool in a manner that permits the take-up core to rotate when the take-up spool rotates. The take-up spool has a driven pulley mounted thereon in order to be driven by a belt. A belt connects the drive pulley to the driven pulley, mechanically engaging each pulley to the other, permitting rotation of the roll of adhesive segment-laden carrier release tape to drive rotation of the spent carrier tape take-up core. A limited amount of slip of the belt is permitted.

An adhesive dispensing wheel is positioned at the nose portion of the adhesive segment applicator apparatus and is rotatably mounted preferably external to the housing of the adhesive segment applicator apparatus. In use, the adhesive dispensing wheel is the point of application for the adhesive segments as they are dispensed on to a surface Preferably, the external circumference of the adhesive dispensing wheel contains a soft overmolded cushion or resilient cushion to permit the nose of the adhesive segment applicator apparatus to engage non-flat, recessed, difficult to reach, or unstable surfaces.

The roll of adhesive segment-laden carrier release tape and the spent tape take-up core are enclosed within the housing of the adhesive segment applicator apparatus. The adhesive dispensing wheel preferably is mounted or configured to be fully or partially external to the housing, to permit the dispensing of the adhesive segments therefrom. The adhesive segment applicator apparatus also may include a handle mounted to or formed within the housing of the adhesive segment applicator apparatus for grasping the adhesive segment applicator apparatus when applying the adhesive segments.

To prepare the adhesive segment applicator apparatus of the present invention for operation, an empty take-up core is inserted onto the take-up spool for collecting spent carrier release tape. Also, a roll of adhesive segment-laden carrier release tape is inserted onto the supply spool and the adhesive segment-laden carrier release is configured in the proper position for operation of the applicator. In particular, the free end of the roll of adhesive segment-laden carrier release tape is fed to the adhesive dispensing wheel and the adhesive segment-laden carrier release tape is partially wrapped around the dispensing wheel with the adhesive segments facing outwardly so that the adhesive segments will be exposed to the intended application surface during operation.

The carrier release tape is then fed from the adhesive dispensing wheel back to the roll of adhesive segment-laden carrier release tape whereby the second surface (the surface from which the adhesive segments are more easily released) of the carrier release tape is in contact with the adhesive segments on the wound roll of adhesive segment-laden carrier release tape. By nature of the externally exposed adhesive segments on the roll of adhesive segment-laden carrier release tape, the second surface of the carrier release tape adheres to the adhesive segments on the wound roll of adhesive segment-laden carrier release tape and is held in place. However, because the second surface of the carrier release tape has a release property different from that of the first so that adhesive segments do not adhere to it as strongly as they do to the first surface, the carrier tape can be advanced across the wound roll of adhesive segment-laden carrier release tape without pulling off adhesive segments from the roll. Finally, the free end of the carrier release tape is then fed to the spent tape take-up core and secured to it.

To operate the adhesive segment applicator apparatus of the present invention, the adhesive segment-laden carrier release tape is installed as described above, and an adhesive segment is exposed at the nose of the applicator apparatus on the adhesive dispensing wheel. The nose of the adhesive dispensing wheel, containing the adhesive segment, is placed in contact with the intended application surface. The adhesive segment is then applied to the intended surface.

The carrier release tape is advanced by motion of the application process. In particular, as the adhesive segment is applied to a surface, the carrier tape is also permitted to move with minimum friction, with the adhesive dispensing wheel, to expose another adhesive segment. Movement of the adhesive dispensing wheel causes additional adhesive segment-laden carrier release tape to move onto the adhesive dispensing wheel, thereby rotating the supply spoon. Because the driven pulley on the take-up spool is driven by the belt, which is in turn driven by the drive pulley on the supply spool, the take-up spool moves to wind the spent carrier release tape onto the take-up core. The action can be performed without the need for an additional advancement mechanism.

In other embodiments of the present invention, the adhesive segment applicator apparatus of the present invention can include either a trigger-activated mechanical advancement mechanism or a power-actuated advancement mechanism. The advancement mechanism can include a trigger-activated, gear-driven mechanical advancement mechanism for use in a hand-held or gun-type applicator apparatus. Alternatively, the advancement mechanism can include a motor or pneumatically driven power-automated actuator for use in an industrial or continuous processing applicator apparatus. The advancement mechanism of the present invention may be driven by any mechanical or power-driven actuator known to those skilled in the art.

In such embodiments, the adhesive segment-laden carrier release tape may be provided with an indexing instrumentality which provides the adhesive segment applicator apparatus with several advantages. First, the indexing is used in the carrier release tape to allow for accurate and specific placement of adhesive segments on the carrier release tape. The indexing is uniformly located in the carrier release tape with regard to the position of adhesive segments at specific locations with respect to the indexing on the carrier release tape. Second, the indexing plays an integral role in the application of the adhesive segments from the carrier release tape. The indices are engagable by the advancement mechanism of the adhesive segment applicator apparatus of the present invention, thereby facilitating advancement of the carrier release tape to present the adhesive segments to a desired surface.

The formation of the indices in the carrier release tape may occur either before or during the actual production of the individual strips of adhesive segment-laden carrier release tape. Regardless of when the carrier release tape is indexed, the indexing may be accomplished by using any one of various methods. For example, the indices may be created by the striking of a steel rule die against the carrier release tape, or, alternatively, by use of a rotary die which turns against the carrier release tape in relation to its linearly displaced cutting surface. While the above methods of cutting are already generally known, their relation to the adhesive segment-laden carrier release tape and adaptation for use in the adhesive segment applicator apparatus of the present invention are novel.

The indexed patterns and embodiments of the carrier release tape may vary. One embodiment includes the creation of notches in the carrier release tape. Specifically, it is contemplated that each indexed notch consists of two angled cuts forming a wide "V" shape in the carrier release tape surface. Such angled, V-shaped cuts may be positioned near opposite sides of the carrier release tape with the points of each V facing away from each other. Thus, the open portions of each pair of indexed notches face one another across the transverse width of the carrier release tape. Indexed patterns other than the notching embodiments discussed above may also be used. For example, the indexed patterns may vary in accordance with the shape and positioning of the advancement mechanism used by the adhesive segment applicator apparatus of the present invention.

Thus, the indexed patterns of the adhesive segment-laden carrier release tape allows for its use with the adhesive segment applicator apparatus of the second and third embodiments of the present invention. The adhesive segment applicator apparatus used in conjunction with the adhesive segment-laden carrier release tape has an advancement mechanism which engages the indexed pattern of the indexed carrier release tape to advance the tape along a desired path. The adhesive segment applicator apparatus thus uses the indexed patterns of the carrier release tape to facilitate the simple, efficient, inexpensive, and safe application of adhesive segments to non-planar, recessed, difficult to reach, or unstable surfaces.

A roll of the indexed adhesive segment-laden carrier release tape is inserted into the adhesive segment applicator apparatus of the second and third embodiments as described herein with respect to the first embodiment of the present invention. The advancement mechanism of the adhesive segment applicator apparatus interacts with the indexed notches of the carrier release tape, thereby advancing the adhesive segments on the carrier release tape to an application point from which the adhesive segments may be applied to a desired surface.

The trigger-actuated adhesive segment applicator apparatus of the present invention includes a handle with a carrier tape advancement release trigger thereon and thus, can be used as a hand-held, gun-type applicator. To dispense an adhesive segment from the trigger-actuated adhesive segment applicator apparatus, the nose of the apparatus is placed in contact with the intended application surface. The trigger is pulled by the user, causing the adhesive segment to be applied to the surface and causing the adhesive segment-laden carrier release tape to advance, thereby exposing the next adhesive segment on the adhesive segment-laden carrier release tape.

The power-actuated, industrial adhesive segment applicator apparatus of the present invention can be supported from a stand, with the application point on the adhesive segment applicator apparatus being oriented in a manner facilitating the application of a workpiece thereto to thereby apply adhesive segments to the workpiece. The stand allows the adhesive segment applicator apparatus to be oriented in a variety of positions allowing the application point on the adhesive segment applicator apparatus to be placed in a variety of orientations. Alternately, the adhesive segment applicator apparatus and stand can be integrally manufactured, with the design of the adhesive segment applicator apparatus facilitating variable orientations of the application point.

It may therefore be seen that the present invention teaches an adhesive segment applicator apparatus including an adhesive segment-laden carrier release tape that is always in a secure position, and is not permitted to come loose or pull away from the adhesive segment applicator apparatus. Indeed, the adhesive segment applicator apparatus of the present invention maintains proper tension on the adhesive segment-laden carrier release tape so that the adhesive segments are easily and efficiently removed from the carrier release tape.

It may also be seen that the adhesive segment applicator apparatus contains a self-advancing adhesive dispensing system including an adhesive dispensing wheel that permits automatic advancement of the adhesive segment-laden carrier release tape during application of an adhesive segment to a surface. In addition, it may be seen that the present invention provides an adhesive segment applicator apparatus that automatically winds the spent carrier release tape onto a roll—thereby reducing the problem of scrap carrier tape interfering with the adhesive application process.

It may also be seen that the adhesive segment applicator apparatus of the present invention may also include an advancement mechanism for use with carrier release tape having an indexing instrumentality, thereby allowing for an advancement mechanism to protrude therethrough for metering and advancement of the carrier release tape.

Each implementation of the adhesive segment applicator apparatus of the present invention is of a construction which is both durable and long lasting, and they will require little or no maintenance to be provided by the user throughout its operating lifetime. The adhesive segment applicator apparatuses of the present invention are also of inexpensive construction to enhance their market appeal and to thereby afford them the broadest possible market. Finally, all of the aforesaid advantages and objectives are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
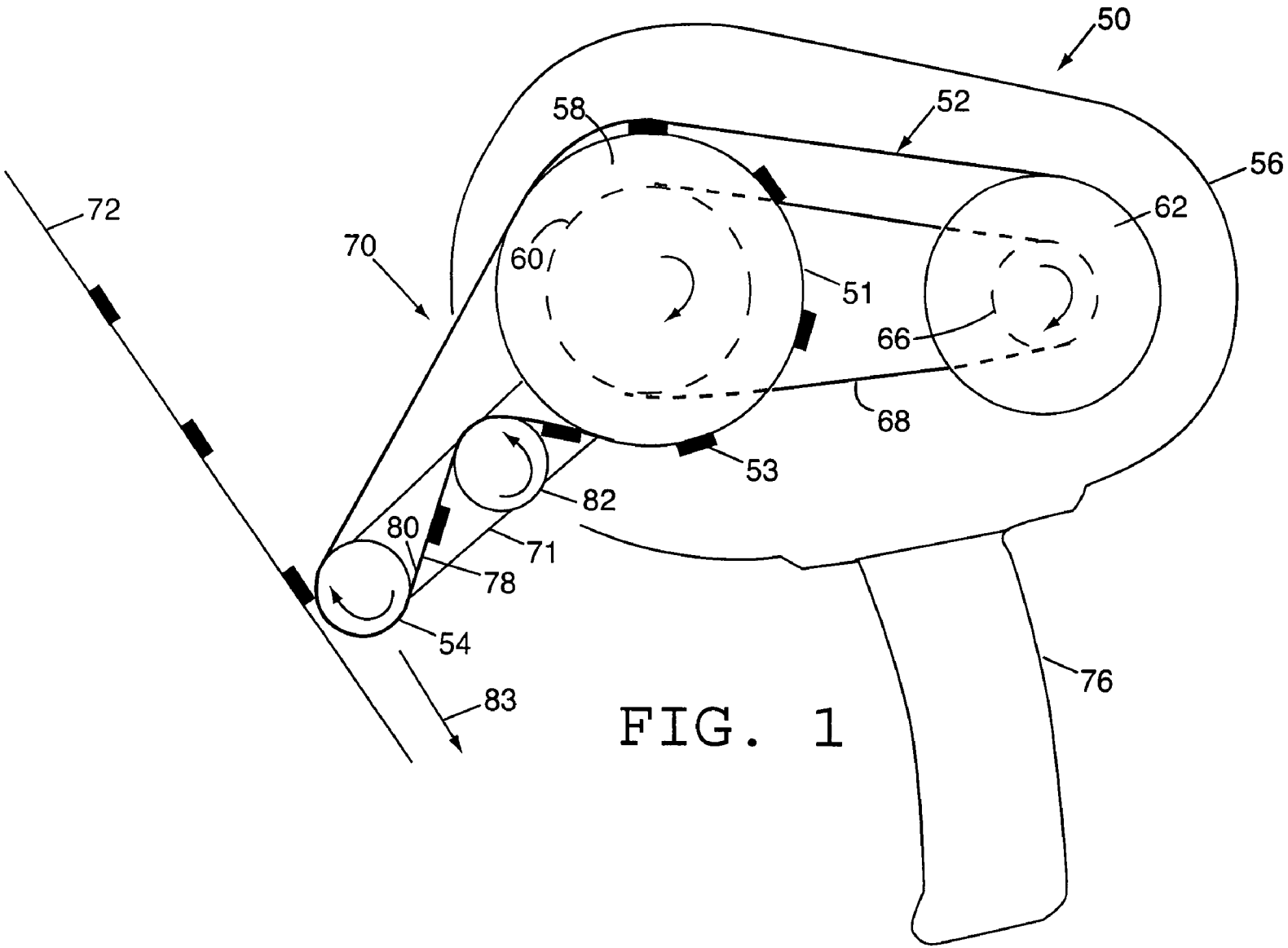
FIG. 1 is an illustrative side plan view of an exemplary adhesive segment applicator apparatus in accordance with the present invention showing use thereof to apply a series of adhesive segments to a workpiece surface.
Figure 2:
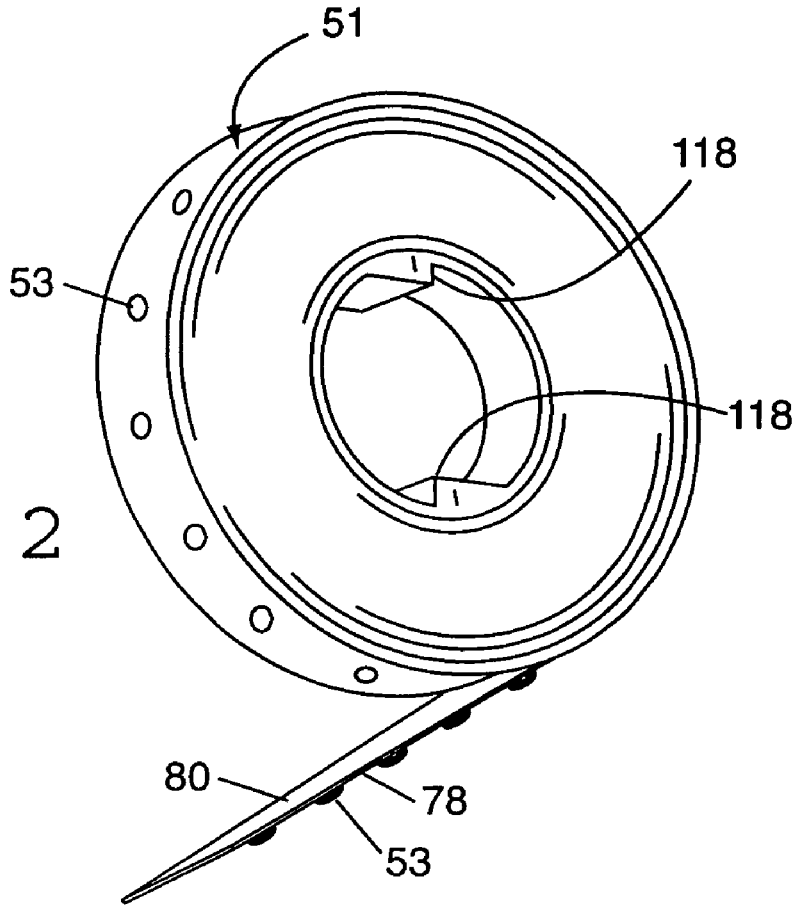
FIG. 2 is an isometric view of a roll of adhesive segment-laden carrier release tape for use in the adhesive segment applicator apparatus illustrated in FIG. 1.

A preferred embodiment of an adhesive segment applicator apparatus 50 of the present invention is illustrated generally in FIG. 1, with an adhesive segment-laden carrier release 51 tape including a plurality of adhesive segments 53 used therein being illustrated in FIG. 2.

Referring first to FIG. 1, the adhesive segment applicator apparatus 50 contains a carrier tape dispensing system, illustrated generally at 52, an adhesive dispensing wheel 54, and an applicator housing 56. The carrier tape dispensing system 52 includes a supply spool 58 rotatably mounted inside the housing 56 of the adhesive segment applicator apparatus 50 by any means known to those skilled in the art. Alternatively, the supply spool 58 may be removably, rotatably mounted with the housing 56 so that supply spools of different sizes can be interchanged with the supply spool 58.

The supply spool 58 is configured to securely support the roll of adhesive segment-laden carrier release tape 51, as illustrated in FIGS. 1 and 2. The roll of adhesive segment-laden carrier release tape 51 engages the supply spool 58, permitting the roll of adhesive segment-laden carrier release tape 51 to rotate when the supply spool 58 rotates.

A drive pulley 60 is mounted to the supply spool 58, on the same axis of rotation as the supply spool 58 so that the drive pulley 60 will rotate as the supply spool 58 rotates. The drive pulley 60 may be mounted to the supply spool 58 in any manner known to those skilled in the art. Alternatively, the supply spool 58 and the drive pulley 60 may be integrally formed and mounted inside the housing 56 of the adhesive segment applicator apparatus 50.

The carrier tape dispensing system 52 also includes a take-up spool 62 rotably mounted inside the housing 56 of the adhesive segment applicator apparatus 50 by any means known to those skilled in the art. Alternatively, the take-up spool 62 may be removably, rotatably mounted with the housing 56 so that take-up spools of different sizes can be interchanged with the take-up spool 62. Preferably, the take-up spool 62 is smaller than the supply spool 58.

The take-up spool 62 is configured to securely support a take-up core 64 for winding spent carrier release tape thereon. The take-up core 64 engages the take-up spool 62, permitting the take-up core 64 to rotate when the take-up spool 62 rotates.

A driven pulley 66 is mounted to the take-up spool 62, on the same axis of rotation as the take-up spool 62 so that the take-up spool 62 will rotate as the driven pulley 66 rotates. The driven pulley 66 may be mounted to the take-up spool 62 in any manner known to those skilled in the art. Alternatively, the take-up spool 62 and the driven pulley 66 may be integrally formed and mounted inside the housing 56 of the adhesive segment applicator apparatus 50.

A belt 68 connects the drive pulley 60 to the driven pulley 66, mechanically engaging each pulley to the other, permitting rotation of the supply spool 58, which in turn drives the rotation of the take-up spool 62. Thus, as the drive pulley 60 rotates to drive the driven pulley 66, the supply spool 58, and therefore the roll of adhesive segment-laden carrier release tape 51 rotates, and the take-up spool 62, and therefore the take-up core 64 rotates. A limited amount of slip of the belt 68 is permitted.

The adhesive dispensing wheel 54 is positioned at a nose portion of the adhesive segment applicator apparatus 50, indicated generally at 70. The adhesive dispensing wheel 54 is rotatably mounted on the end of a support structure 71 extending from the nose portion 70 of the adhesive segment applicator apparatus 50. In use, the adhesive dispensing wheel 54 is the point of application for the adhesive segments 53 as they are dispensed on to a surface 72. Preferably, the adhesive dispensing wheel 54 is formed of or contains a soft over-molded cushion or resilient cushion around its external circumference to permit the nose 70 of the adhesive segment applicator apparatus 50 to engage non-flat, recessed, difficult to reach, or unstable surfaces.

The roll of adhesive segment-laden carrier release tape 51 and the spent tape take-up spool are enclosed within the housing 56 of the adhesive segment applicator apparatus 50. The adhesive dispensing wheel 54 preferably is configured to be at least partially outside the housing 56 of the adhesive segment applicator apparatus 50. Alternatively, the adhesive dispensing wheel may be partially enclosed within the housing 56, except for a portion of the adhesive dispensing wheel 54 which is exposed to permit the dispensing of the adhesive segments 53.

The adhesive segment applicator apparatus 50 also includes a handle 76 mounted to or formed within the housing 56 of the adhesive segment applicator apparatus 50 for grasping the adhesive segment applicator apparatus 50 when applying the adhesive segments 53.

To prepare the adhesive segment applicator apparatus 50 of the present invention for operation a roll of adhesive segment-laden carrier release tape 51 is inserted onto the supply spool 58 and the roll of adhesive segment-laden carrier release tape 51 is configured in the proper position for operation of the applicator apparatus 50.

As illustrated in FIG. 1, the roll of adhesive segment-laden carrier release tape is wound with the adhesive segments 53 facing outwardly, i.e. with a first surface 78 facing outwardly, and with a second surface 80 facing inwardly. The second surface 80 of the carrier release tape has a release property different from that of the first surface 78 so that adhesive segments 53 do not adhere to the second surface 80 as strongly as they do to the first surface 78.

A free end of the roll of adhesive segment-laden carrier release tape 51 is fed to the adhesive dispensing wheel 54 and the adhesive segment-laden carrier release tape is partially wrapped around the adhesive dispensing wheel 54 with the adhesive segments 53 facing outwardly so that the adhesive segments 53 will be exposed to the intended application surface 72 during operation. The adhesive segment carrier release tape 51 may be fed to the adhesive dispensing wheel 54 via a tape guide wheel 82. The tape guide wheel 82 may be rotatably mounted to the support structure 71 extending from the nose 70 of the adhesive segment applicator apparatus between the adhesive dispensing wheel 54 and the supply spool 58. The tape guide wheel 82 may be made of, or covered with, an appropriate material (such as silicone rubber) having a release property much less than that of the first surface 78 of the adhesive segment carrier release tape 51 to which the adhesive segments 53 are attached. Thus, as the carrier release tape 51 is moved past the tape guide wheel 82 during operation of the adhesive segment applicator apparatus 50, in the manner to be described below, the adhesive segments 53 do not come off of the carrier release tape 51 onto the tape guide wheel 82.

The carrier release tape is fed from the adhesive dispensing wheel 54 back to the roll of adhesive segment-laden carrier release tape 51 whereby the second surface 80 (the surface from which the adhesive segments 53 are more easily released) of the carrier release tape is in contact with the adhesive segments 53 on the wound roll of adhesive segment-laden carrier release tape 51. By nature of the externally exposed adhesive segments 53 on the roll of adhesive segment-laden carrier release tape 51, the second surface 80 of the carrier release tape adheres to the adhesive segments 53 on the wound roll of adhesive segment-laden carrier release tape 51 and is held in place. However, because the second surface 80 of the carrier release tape has a release property different from that of the first surface 78 the adhesive segments 53 do not adhere to it as strongly as they do to the first surface 78, the carrier tape can be advanced across the wound roll of adhesive segment-laden carrier release tape 51 without pulling off adhesive segments 53 from the roll. Finally, the free end of the carrier release tape is then fed to the spent tape take-up spool 62 and secured to it.

To operate the adhesive segment applicator apparatus 50 of the present invention, the adhesive segment-laden carrier release tape 51 is installed as described above, and an adhesive segment 53 is exposed at the nose 70 of the adhesive segment applicator apparatus 50 on the adhesive dispensing wheel 54. The nose 70 of the adhesive dispensing wheel 54, containing the adhesive segment 53, is placed in contact with the intended application surface 72. The adhesive segment 53 is then applied to the intended surface.

The carrier release tape is advanced by motion of the application process. In particular, as the adhesive segment 53 is applied to a surface 72, e.g., by moving the adhesive segment applicator apparatus 50 across the surface 72 in the direction 83, the carrier tape is also permitted to move with minimum friction, with the adhesive dispensing wheel 54, to expose another adhesive segment 53. Movement of the adhesive dispensing wheel 54 causes additional adhesive segment-laden carrier release tape to move onto the adhesive dispensing wheel 54, thereby rotating the supply spool in a clockwise direction. Because the driven pulley 66 on the take-up spool 62 is driven by the belt 68, which is in turn driven by the drive pulley 60 on the supply spool 58, the take-up spool 62 moves in a clockwise direction to wind the spent carrier release tape onto the take-up spool 62. The action can be performed without the need for an additional advancement mechanism. Thus, an adhesive segment applicator apparatus 50 in accordance with the present invention can be used easily to deposit a series or row of adhesive segments 53 along a workpiece surface 72.

A more detailed description of the construction of an exemplary adhesive segment applicator apparatus 50 in accordance with the present invention now will be presented with reference to FIGS. 3-17. All of the components to be described may be molded or otherwise formed of appropriate materials as known in the art, such as molded plastic, to provide a durable adhesive segment applicator apparatus in accordance with the present invention.

Figure 4:
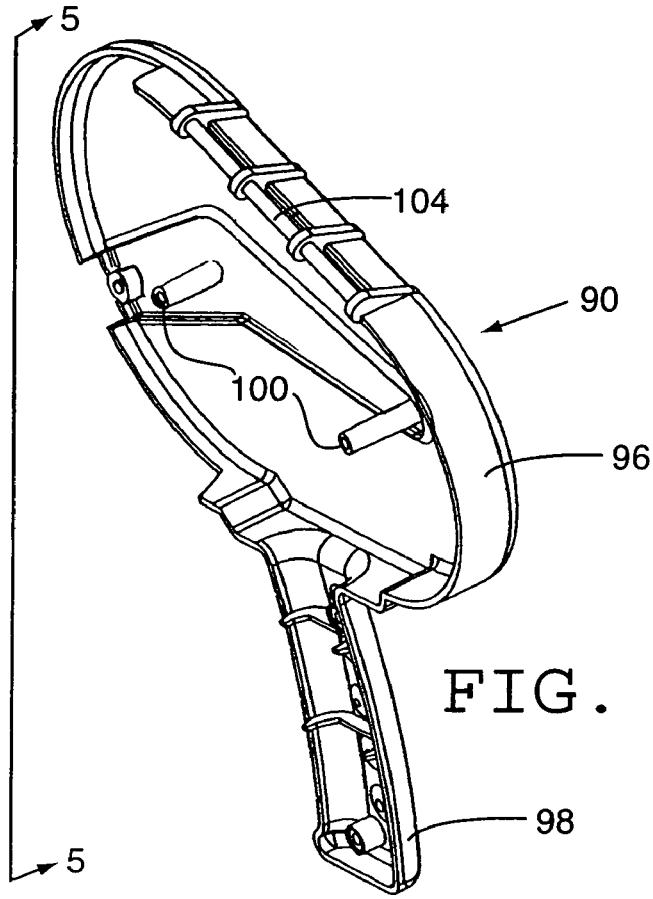
FIGS. 4 and 5 are isometric and plan views, respectively, of a right portion of a housing for the exemplary adhesive segment applicator apparatus of FIG. 3.
Figure 5:
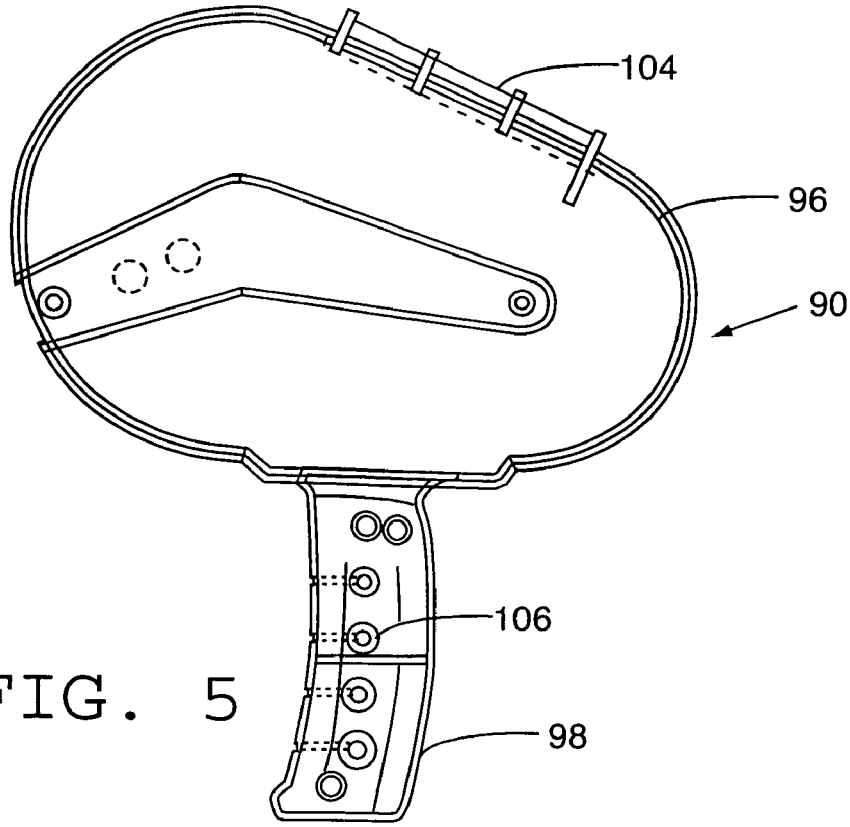

The housing 56 of the adhesive segment applicator apparatus 50 preferably may be formed in three parts, a right housing portion 90, a housing door 92, and a left handle portion 94. An exemplary right housing portion 90 is illustrated in FIGS. 4 and 5. The right housing portion 90 itself has two main portions or segments, a main body portion 96 and a handle portion 98. The main body 96 and handle 98 portions of the right housing portion 90 may be integrally formed. The main body portion 96 of the right housing portion 90 forms half of the portion of the housing 56 in which the supply 58 and take-up 62 spools reside. The main body portion 96 includes projections 100 or other structures formed therein upon which the supply 58 and take-up 62 spools may be mounted and/or to which a spool and wheel spine support structure 102 (to be described in more detail below) may be mounted. The main body portion 96 also may include structures 104 formed thereon that form one half of a hinge structure whereby the housing door 92 is attached in a hinged relation to the right housing portion 90. The handle portion 98 of the right housing portion preferable may have various structures 106 formed thereon to improve the grip provided by the handle 76.

Figure 6:
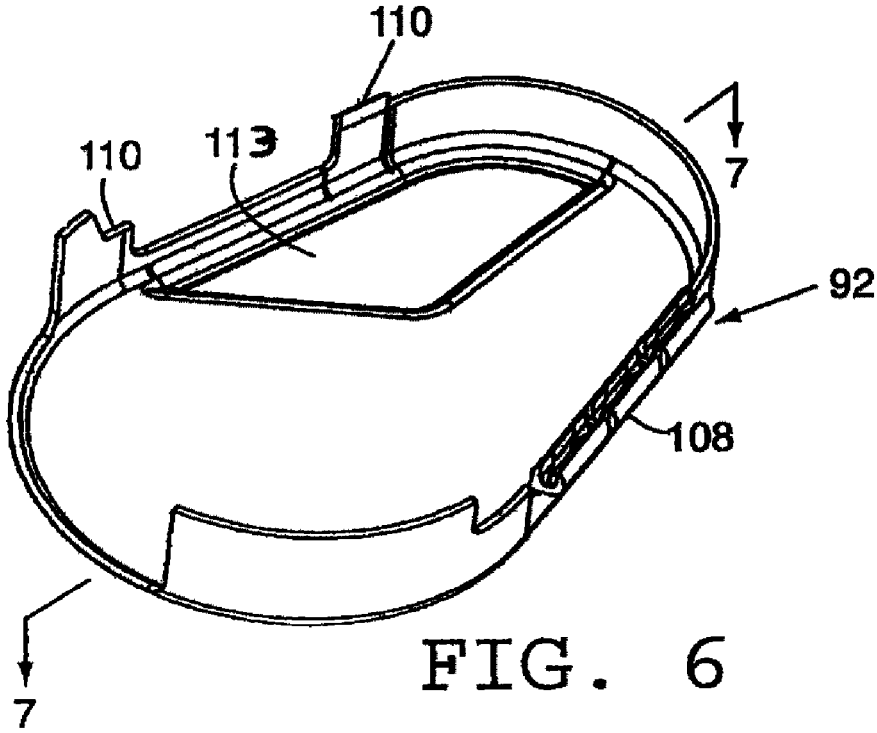
FIGS. 6 and 7 are isometric and plan views, respectively, of a housing door for the exemplary adhesive segment applicator apparatus of FIG. 3.
Figure 7:
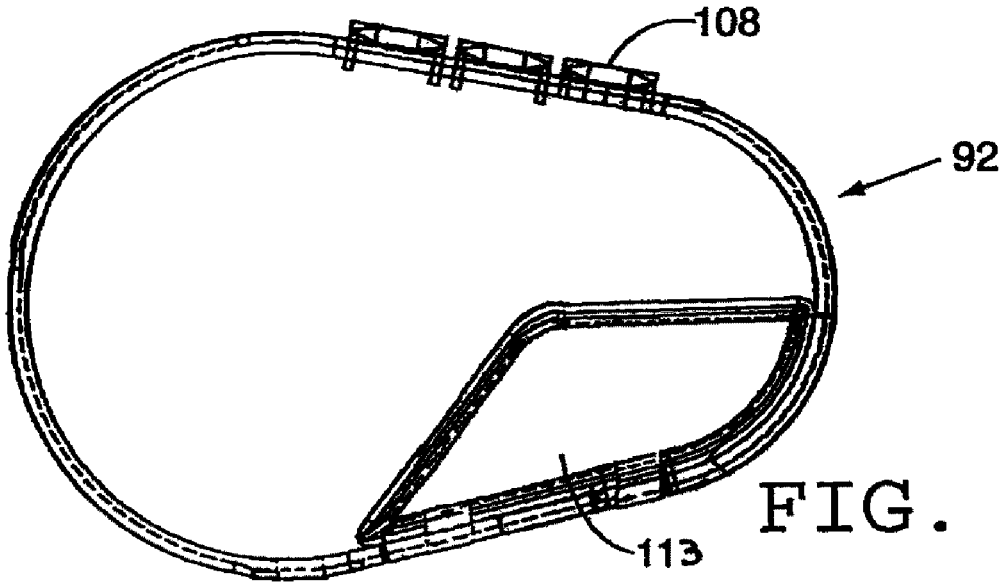

An exemplary housing door 92 is illustrated in FIGS. 6 and 7. The housing door 92, when attached to the main body portion 96 of the right housing portion 90, forms the other half of the portion of the housing 56 in which the supply 58 and take-up 62 spools reside. The housing door 92 may have formed thereon complementary hinge portions 108 to the hinge portions 104 formed on the right housing portion 90. Thus, the housing door 92 may be attached in a hinged relationship to the right housing portion 90 such that the door 92 may be opened and closed easily to allow supply reels 58 of adhesive segment laden carrier release tape 51 to be placed in the adhesive segment applicator apparatus 50 and spools 62 of spent carrier release tape to be removed from the housing apparatus 50. An appropriate latch structure or structures 110 may be formed on the housing door 92 to engage the right housing portion 90 to keep the housing door closed. A window 113, e.g., covered with a transparent plastic material, may be formed in the housing door 92 to allow an operator to see how much carrier release tape 51 with adhesive segments 53 mounted thereon remains on the supply spool 58 without having to open the housing door 92.

Figure 8:
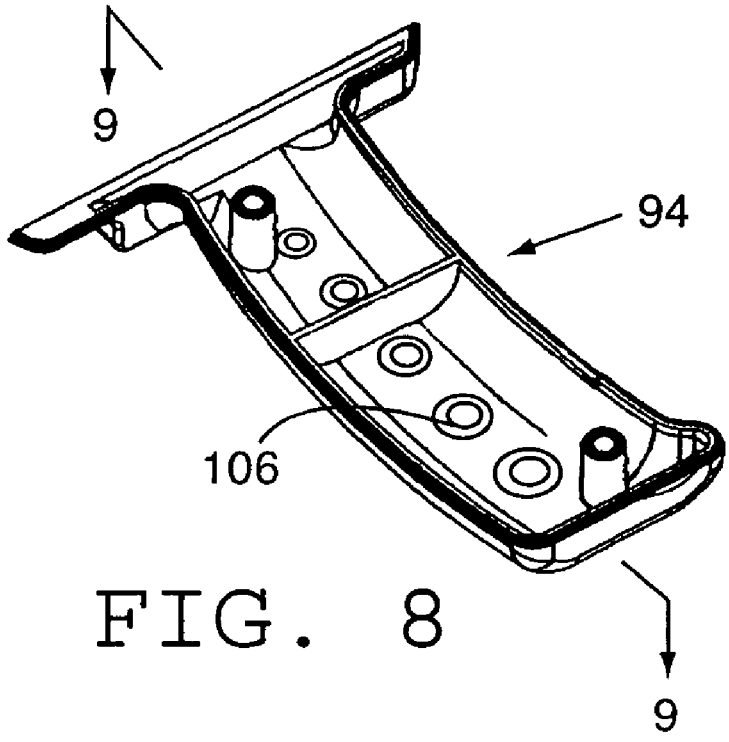
FIGS. 8 and 9 are isometric and plan views, respectively, of a left handle portion for the housing of the exemplary adhesive segment applicator apparatus of FIG. 3.
Figure 9:
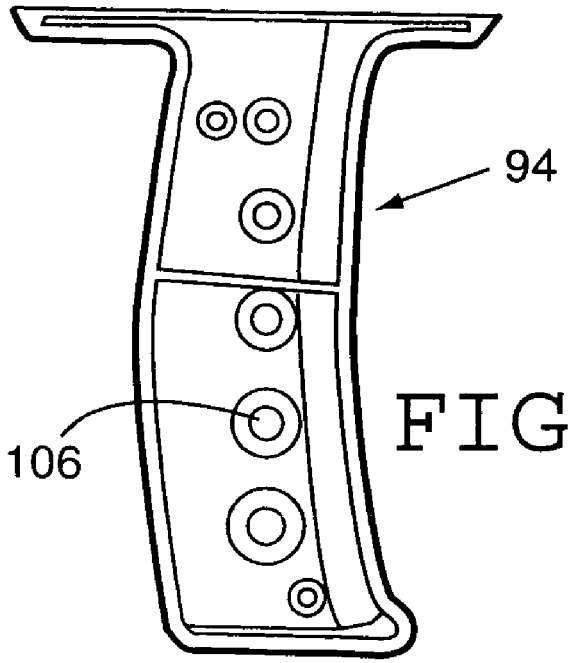

An exemplary left handle portion 94 is illustrated in FIGS. 8 and 9. The left handle portion 94 may have structures 106 formed therein to improve the grip of the handle 76 for the adhesive segment applicator apparatus 50 formed thereby in combination with the handle portion 98 of the right housing portion 90. The left handle portion 94 preferably may be fixedly attached to the handle portion 98 of the right housing portion in a conventional manner, e.g., using an adhesive, by sonic welding, etc.

Figure 10:
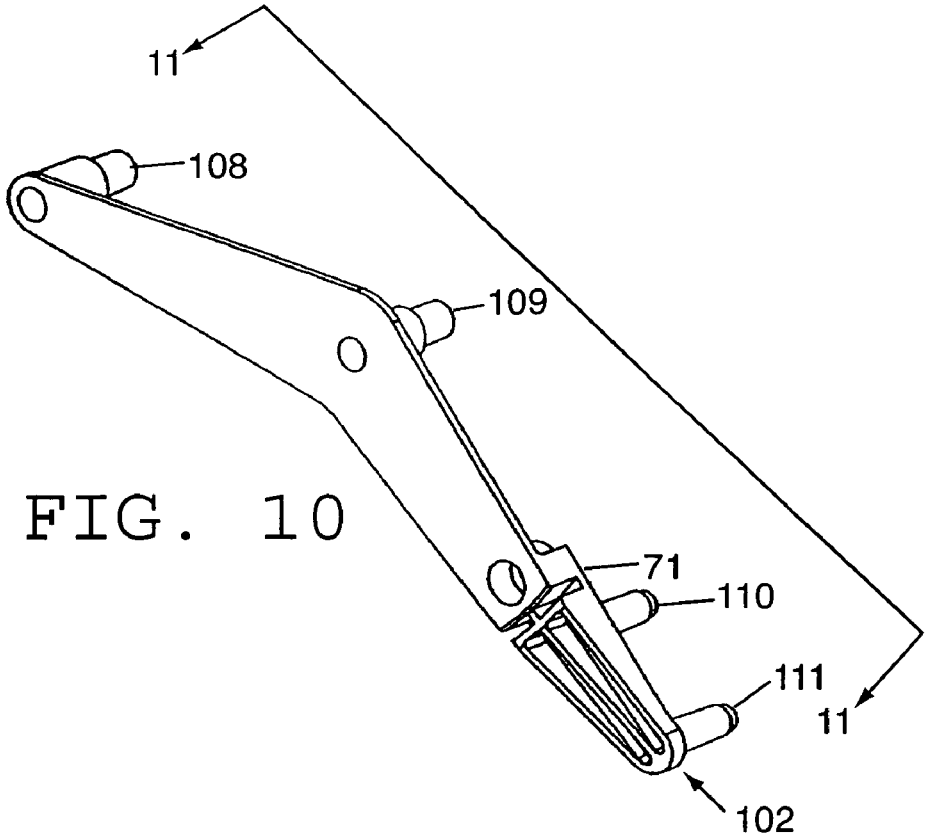
FIGS. 10 and 11 are isometric and plan views, respectively, of a spool and wheel mounting spine structure for the exemplary adhesive segment applicator apparatus of FIG. 3.
Figure 11:
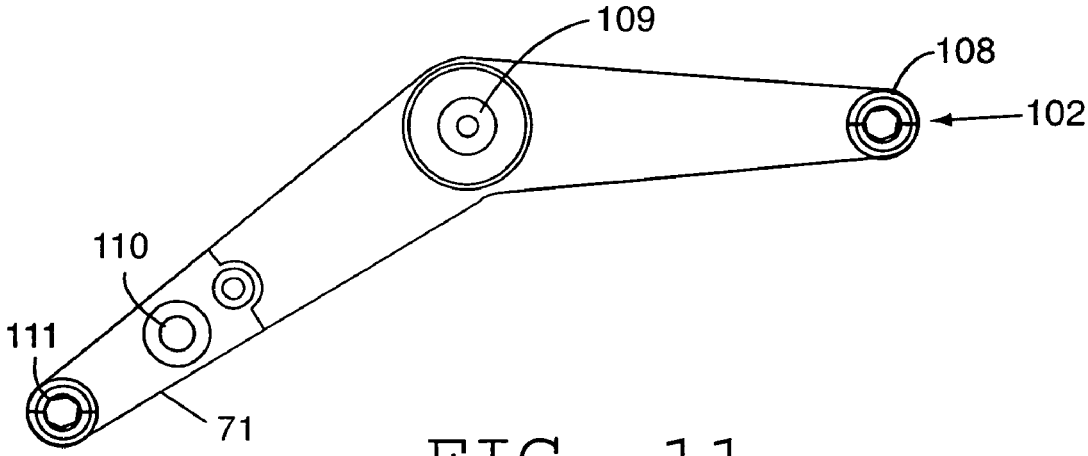

An exemplary spool and wheel spine mounting structure 102 is illustrated in FIGS. 10. and 11. The mounting structure 102 is mounted within the housing 56 and forms a structure to which the supply 58 and take-up spools 62 as well as the adhesive dispensing 54 and tape guide 82 wheels are rotatably attached. Thus, the mounting structure 102 includes projections 108, 109, 111, and 110, formed thereon to which the take-up 62 and supply 58 spools and adhesive dispensing 54 and tape guide 82 wheels may be mounted, respectively.

Figure 12:
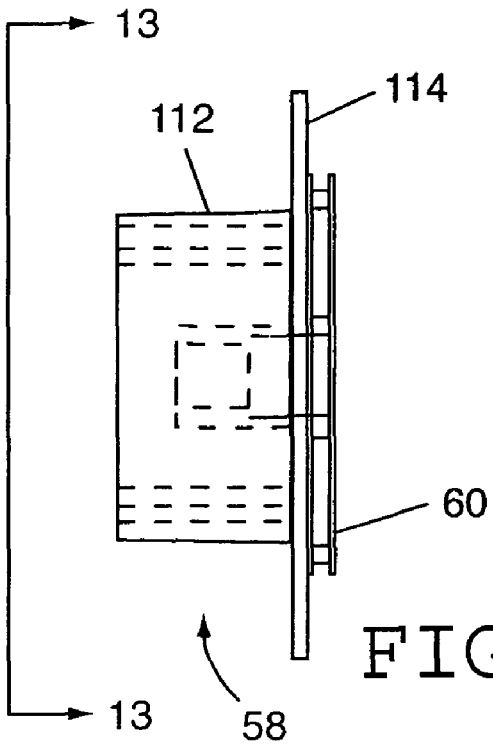
FIGS. 12 and 13 are side and plan views, respectively, of a supply spool for the exemplary adhesive segment applicator apparatus of FIG. 3.
Figure 13:
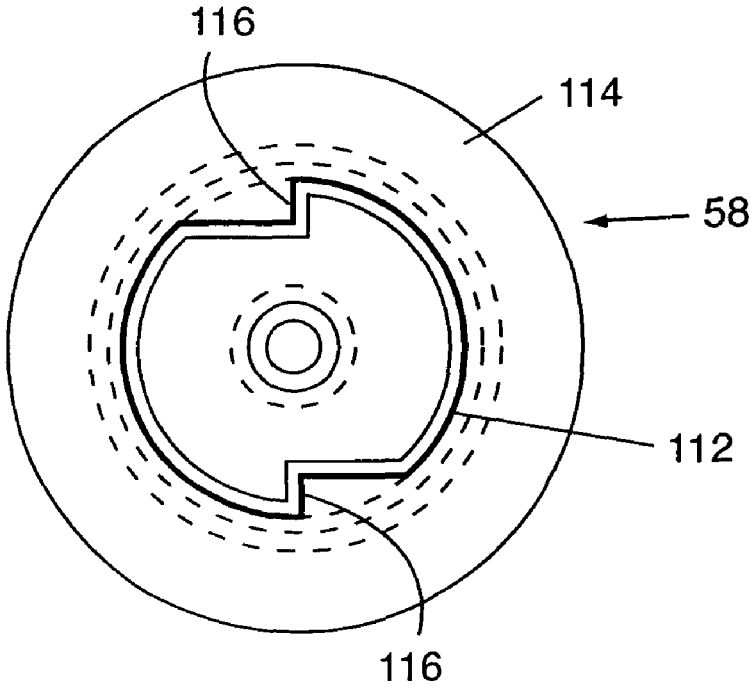

An exemplary supply spool 58 in accordance with the present invention is illustrated in FIGS. 12 and 13. The supply spool 58 is rotatably mounted on the projection 109 of the spine mounting structure 102. The supply spool 58 includes a tape roll supporting core 112 on the other side of a separating plate portion 114 opposite the drive pulley 60 formed as part thereof. The tape roll supporting core 112 may be formed with appropriate indentations 116 formed therein which cooperate with corresponding projections 118 formed on the tape roll (see FIG. 2), or vice versa, to ensure that the tape roll is placed on the supply spool 58 in the correct orientation.

Figure 14:
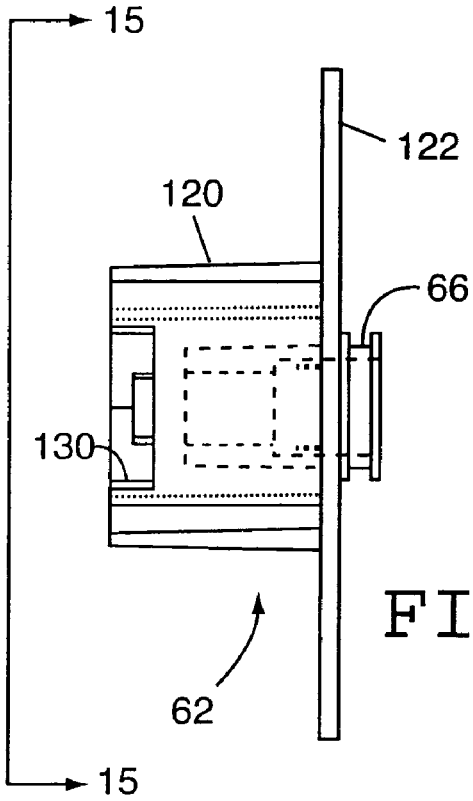
FIGS. 14 and 15 are side and plan views, respectively, of a take-up core for the exemplary adhesive segment applicator apparatus of FIG. 3.
Figure 15:
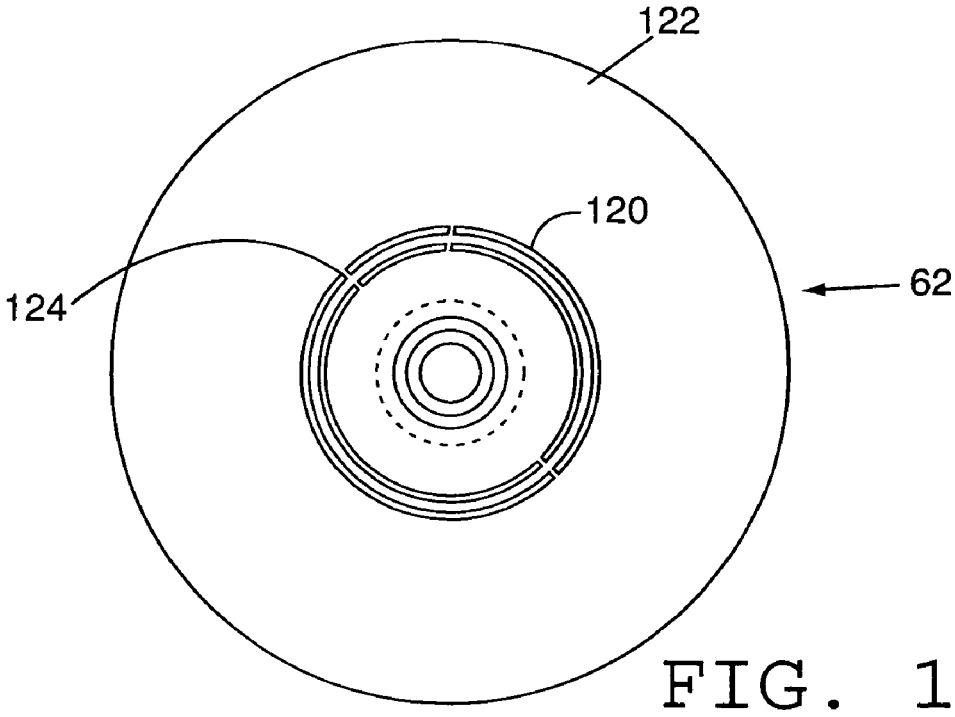
Figure 16:
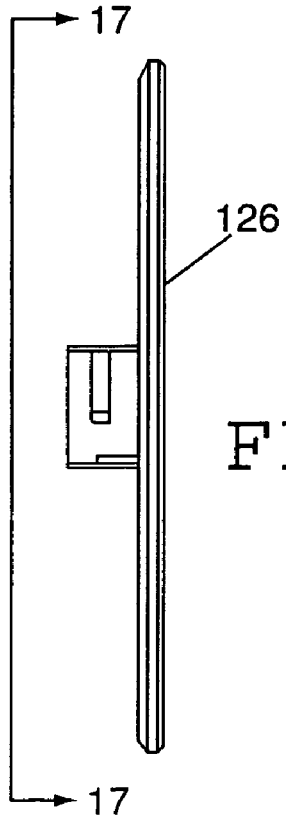
FIGS. 16 and 17 are side and plan views, respectively, of a tape retainer for the take-up core of the exemplary adhesive segment applicator apparatus of FIG. 3.

An exemplary take-up spool 62 in accordance with the present invention is illustrated in more detail in FIGS. 14 and 15. The take-up spool 62 is rotatably mounted on the projection 108 of the spine mounting structure 102. The take-up spool 62 includes a spent tape accumulating core 120 on the other side of a separating plate portion 122 from the driven pulley 66 formed as part thereof. Spent carrier release tape, with the adhesive segments removed therefrom, is wound around the accumulating core 120 portion of the take-up spool 62. Slots 124 or other structures may be formed in the core 120 of the take-up spool in which the end of the carrier release tape may be positioned to removably attach the end of the carrier release tape to the take-up spool 62. The slots 124 allow the roll of spent release tape easily to be removed from the take-up spool 62 to be discarded.

Figure 17:
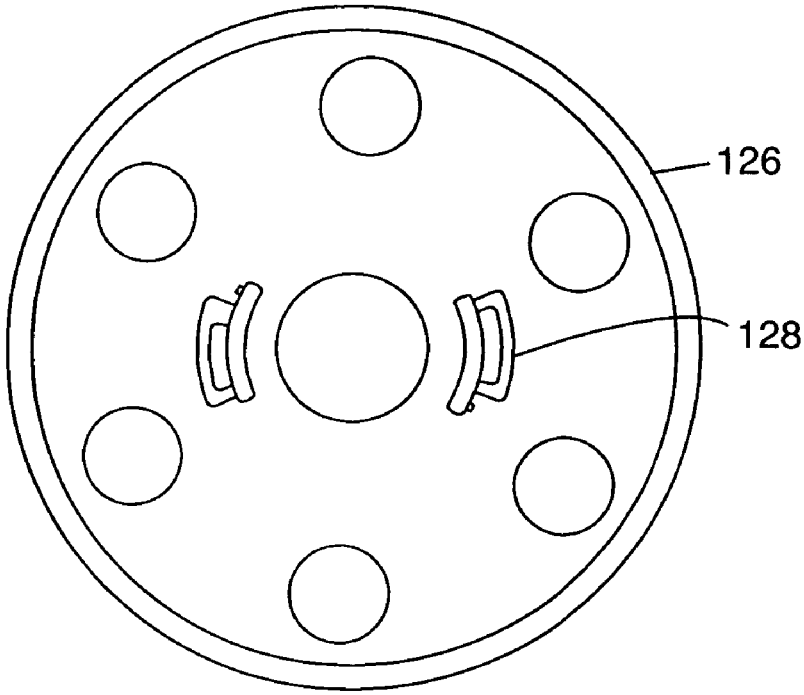
Figure 18:
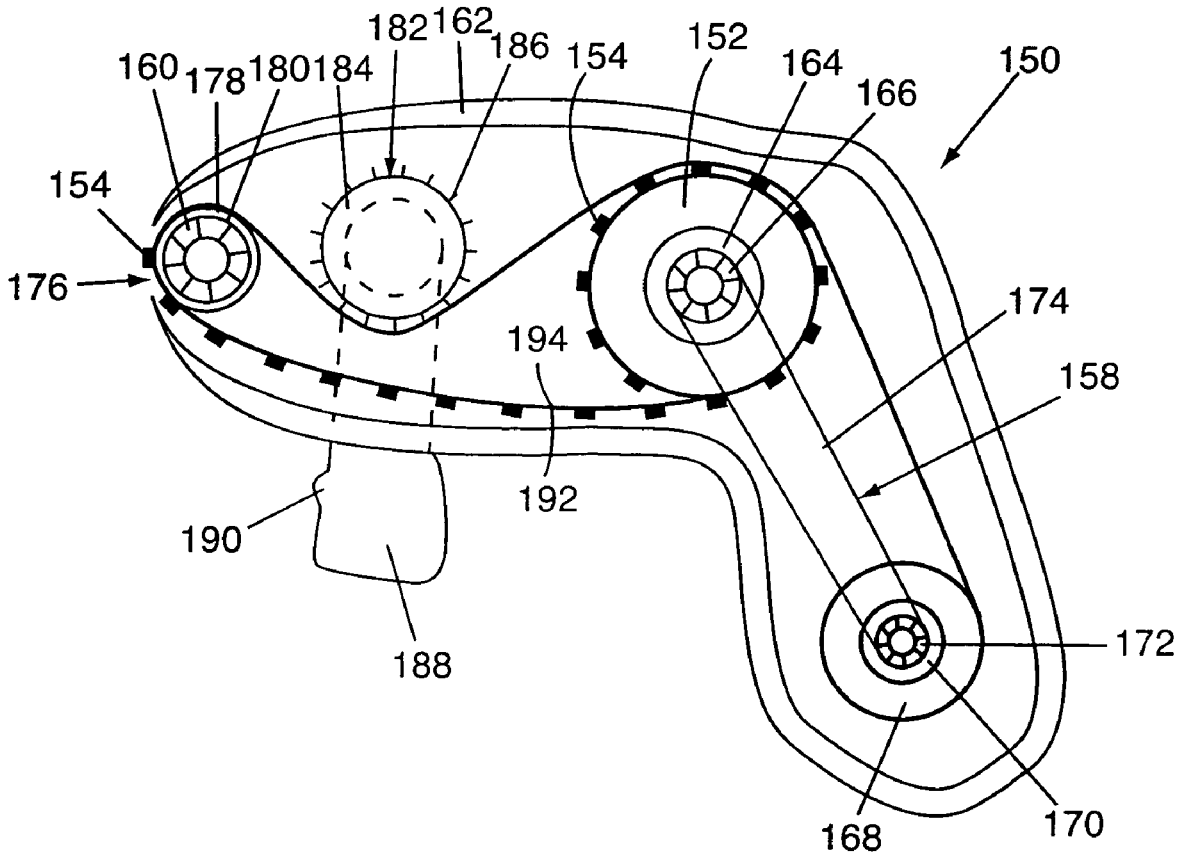
FIG. 18 is a side plan view of a first alternate embodiment of the adhesive segment applicator apparatus of the present invention.

An exemplary tape retainer 126 for the take-up spool 62 is illustrated in more detail in FIGS. 17 and 18. The tape retainer 126 has a structure 128 formed thereon such that the tape retainer 126 may be removably mounted to the core 122 of the take-up spool 62. When in position on the take-up spool 62 the tape retainer 126 maintains and directs the spent release tape being wound on the take-up spool into a neat roll. The tape retainer 126 may be easily removed from the take-up spool 62 to allow the roll of spent release tape to be removed therefrom to be discarded.

Figure 19:
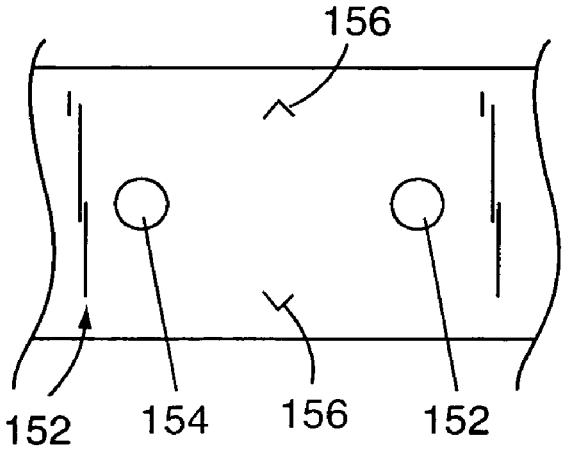
FIG. 19 is a top plan view of a segment of an indexed adhesive segment-laden carrier release tape showing optional indexing therein for use in the adhesive segment applicator apparatus illustrated in FIG. 18.
Figure 3:
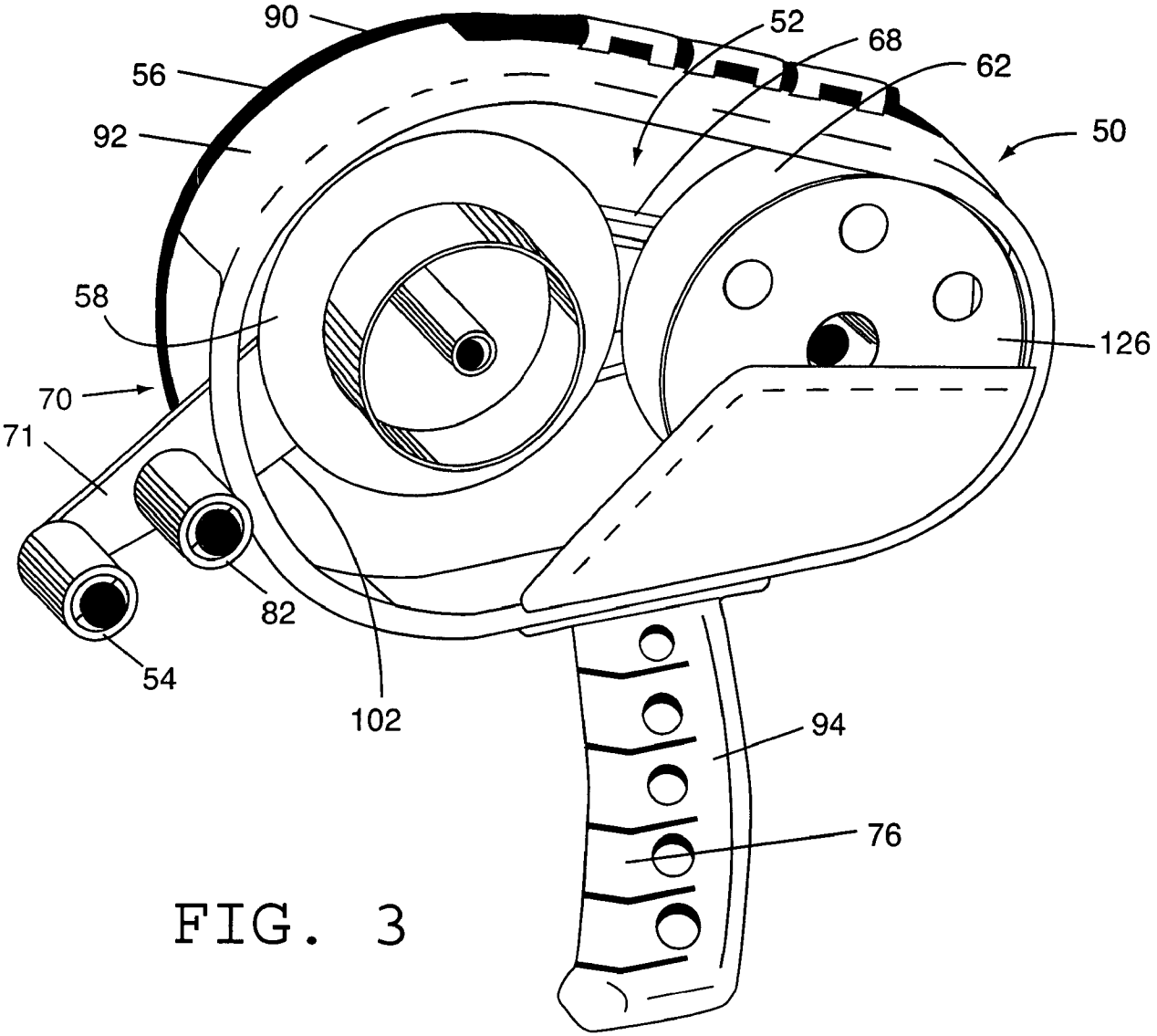
FIG. 3 is a more detailed isometric view of the exemplary adhesive segment applicator apparatus illustrated in FIG. 1.

FIG. 18 illustrates a first alternate embodiment of an adhesive segment applicator apparatus 150 of the present invention, which will be used with a roll of indexed adhesive segment-laden carrier release tape 152 including a plurality of adhesive segments 154 and indexed notches 156 therebetween, as also illustrated in FIG. 19. Referring first to FIG. 18, the adhesive segment applicator apparatus 150 contains a carrier tape dispensing system, illustrated generally at 158, an adhesive dispensing wheel 160, and applicator housing 162.

The carrier tape dispensing system 158 includes a supply spool 164 rotatably mounted inside the housing 162 of the adhesive segment applicator apparatus 150 by any means known to those skilled in the art. Alternatively, the supply spool 164 may be removably, rotatably mounted with the housing 162 so that supply spools of different sizes can be interchanged with the supply spool 164.

The supply spool 164 is configured to securely support the roll of indexed adhesive segment-laden carrier release tape 152, as illustrated in FIGS. 18 and 19. The roll of indexed adhesive segment-laden carrier release tape 152 engages the supply spool 164, permitting the roll of indexed adhesive segment-laden carrier release tape 152 to rotate when the supply spool 164 rotates.

A drive pulley 166 is mounted to the supply spool 164, on the same axis of rotation as the supply spool 164 so that the supply spool 164 will rotate as, the drive pulley 166 rotates. The drive pulley 166 may be mounted to the supply spool 164 in any manner known to those skilled in the art. Alternatively, the supply spool 164 and the drive pulley 166 may be integrally formed and mounted inside the housing 162 of the adhesive segment applicator apparatus 150.

The carrier tape dispensing system 158 also includes a take-up spool 168 rotably mounted inside the housing 162 of the adhesive segment applicator apparatus 150 by any means known to those skilled in the art. Alternatively, the take-up spool 168 may be removably, rotatably mounted with the housing 162 so that take-up spools of different sizes can be interchanged with the take-up spool 168. Preferably, the take-up spool 168 is smaller than the supply spool 164.

The take-up spool 168 is configured to securely support a take-up core 170 for winding spent carrier release tape thereon. The take-up core 170 engages the take-up spool 168, permitting the take-up core 170 to rotate when the take-up spool 168 rotates.

A driven pulley 172 is mounted to the take-up spool 168, on the same axis of rotation as the take-up spool 168 so that the take-up spool 168 will rotate as the driven pulley 172 rotates. The driven pulley 172 may be mounted to the take-up spool 168 in any manner known to those skilled in the art. Alternatively, the take-up spool 168 and the driven pulley 172 may be integrally formed and mounted inside the housing 162 of the adhesive segment applicator apparatus 150.

A belt 174 connects the drive pulley 166 to the driven pulley 172, mechanically engaging each pulley to the other, permitting rotation of the supply spool 164, which in turn drives the rotation of the take-up spool 170. Thus, as the drive pulley 166 rotates to drive the driven pulley 172, the supply spool 164, and therefore the roll of indexed adhesive segment-laden carrier release tape 152 rotates, and the take-up spool 170, and therefore the take-up core 168 rotates. A limited amount of slip of the belt 174 is permitted.

The adhesive dispensing wheel 160 is positioned at a nose portion of the adhesive segment applicator apparatus 150, indicated generally at 176. The adhesive dispensing wheel 160 is rotatably mounted within the housing 162 of the adhesive segment applicator apparatus 150. In use, the adhesive dispensing wheel 160 is the point of application for the adhesive segments 154 as they are dispensed on to a surface. Preferably, the adhesive dispensing wheel 160 contains a soft overmolded cushion or resilient cushion 178 around its external circumference 180 of the adhesive dispensing wheel 160 to permit the nose 176 of the adhesive segment applicator apparatus 150 to engage non-flat, recessed, difficult to reach, or unstable surfaces.

The roll of indexed adhesive segment-laden carrier release tape 152 and the spent tape take-up core 168 are enclosed within the housing 162 of the adhesive segment applicator apparatus 150. The adhesive dispensing wheel 160 is partially enclosed within the housing 162, except for a portion of the adhesive dispensing wheel 160 which is exposed to permit the dispensing of the adhesive segments 154. Alternatively, the adhesive dispensing wheel 160 may be configured to be outside the housing 162 of the adhesive segment applicator apparatus 150.

The adhesive segment applicator apparatus 150 also includes an advancement mechanism, indicated generally at 182, for advancing the indexed adhesive segment-laden carrier release tape 152 through the adhesive segment applicator apparatus 150. The advancement mechanism 182 includes a tape feed wheel 184 with a plurality of teeth 186 thereon. The teeth 186 are arranged and configured to interact with the indexed notches 156 of the indexed carrier release tape 152. The advancement mechanism 182 can include a trigger-activated or any gear-driven mechanical advancement mechanism for use in a hand-held or gun-type applicator apparatus known to those skilled in the art.

The advancement mechanism 182 includes a handle 188 for grasping the adhesive segment applicator apparatus 150 and a trigger mechanism 190 for advancing the tape feed wheel 184 and the indexed adhesive segment-laden carrier release tape 152.

To prepare the adhesive segment applicator apparatus 150 of the present invention for operation, an empty take-up core 168 is inserted onto the take-up spool 170 for collecting spent carrier release tape. Also, a roll of indexed adhesive segment-laden carrier release tape 152 is inserted onto the supply spool 164 and the roll of indexed adhesive segment-laden carrier release tape 152 is configured in the proper position for operation of the applicator apparatus 150.

As illustrated in FIG. 18, the roll of indexed adhesive segment-laden carrier release tape 152 is wound with the adhesive segments 154 facing outwardly, i.e. with a first surface 192 facing outwardly, and with a second surface 194 facing inwardly. The second surface 194 of the carrier release tape has a release property different from that of the first surface 192 so that adhesive segments 154 do not adhere to the second surface 194 as strongly as they do to the first surface 192.

A free end of the roll of indexed adhesive segment-laden carrier release tape 152 is fed to the adhesive dispensing wheel 160 and the indexed adhesive segment-laden carrier release tape 152 is partially wrapped around the adhesive dispensing wheel 160 with the adhesive segments 154 facing outwardly so that the adhesive segments 154 will be exposed to the intended application surface during operation.

The carrier release tape 152 is then fed from the adhesive dispensing wheel 160 to the tape feed wheel 184. The teeth 186 of the tape feed wheel 184 engage the indexed notches 156 of the carrier release tape 152 in order to advance the carrier release tape 152 through the adhesive segment applicator apparatus 150. The carrier release tape is then fed back to the roll of indexed adhesive segment-laden carrier release tape 152 whereby the second surface 194 (the surface from which the adhesive segments 154 are more easily released) of the carrier release tape is in contact with the adhesive segments 154 on the wound roll of indexed adhesive segment-laden carrier release tape 152. By nature of the externally exposed adhesive segments 154 on the roll of indexed adhesive segment-laden carrier release tape 152, the second surface 194 of the carrier release tape adheres to the adhesive segments 154 on the wound roll of indexed adhesive segment-laden carrier release tape 152 and is held in place. However, because the second surface 194 of the carrier release tape has a release property different from that of the first surface 192 the adhesive segments 154 do not adhere to it as strongly as they do to the first surface 192, the carrier tape can be advanced across the wound roll of indexed adhesive segment-laden carrier release tape 152 without pulling off adhesive segments 154 from the roll. Finally, the free end of the carrier release tape is then fed to the spent tape take-up core 170 and secured to it.

To operate the adhesive segment applicator apparatus 150 of the present invention, the indexed adhesive segment-laden carrier release tape 152 is installed as described above, and an adhesive segment 154 is exposed at the nose 176 of the adhesive segment applicator apparatus 150 on the adhesive dispensing wheel 160. The nose 176 of the adhesive dispensing wheel 160, containing the adhesive segment 154, is placed in contact with the intended application surface. The trigger mechanism 190 is engaged and the adhesive segment 154 is then applied to the intended surface by advancement of the carrier release tape.

The carrier release tape is advanced by the advancement mechanism 182. In particular, when the trigger mechanism is engaged and the adhesive segment 154 is applied to a surface, the carrier tape is also advanced by the tape feed wheel 184 of the advancement mechanism 182 which advances the adhesive dispensing wheel 160, to expose another adhesive segment 154. Movement of the adhesive dispensing wheel 160 causes additional indexed adhesive segment-laden carrier release tape to move onto the adhesive dispensing wheel 160, thereby rotating the supply spool 164 in a clockwise direction. Because the driven pulley 172 on the take-up spool 170 is driven by the belt 174, which is in turn driven by the drive pulley 166 on the supply spool 164, the take-up spool 170 moves in a clockwise direction to wind the spent carrier release tape onto the take-up core 168.

Figure 20:
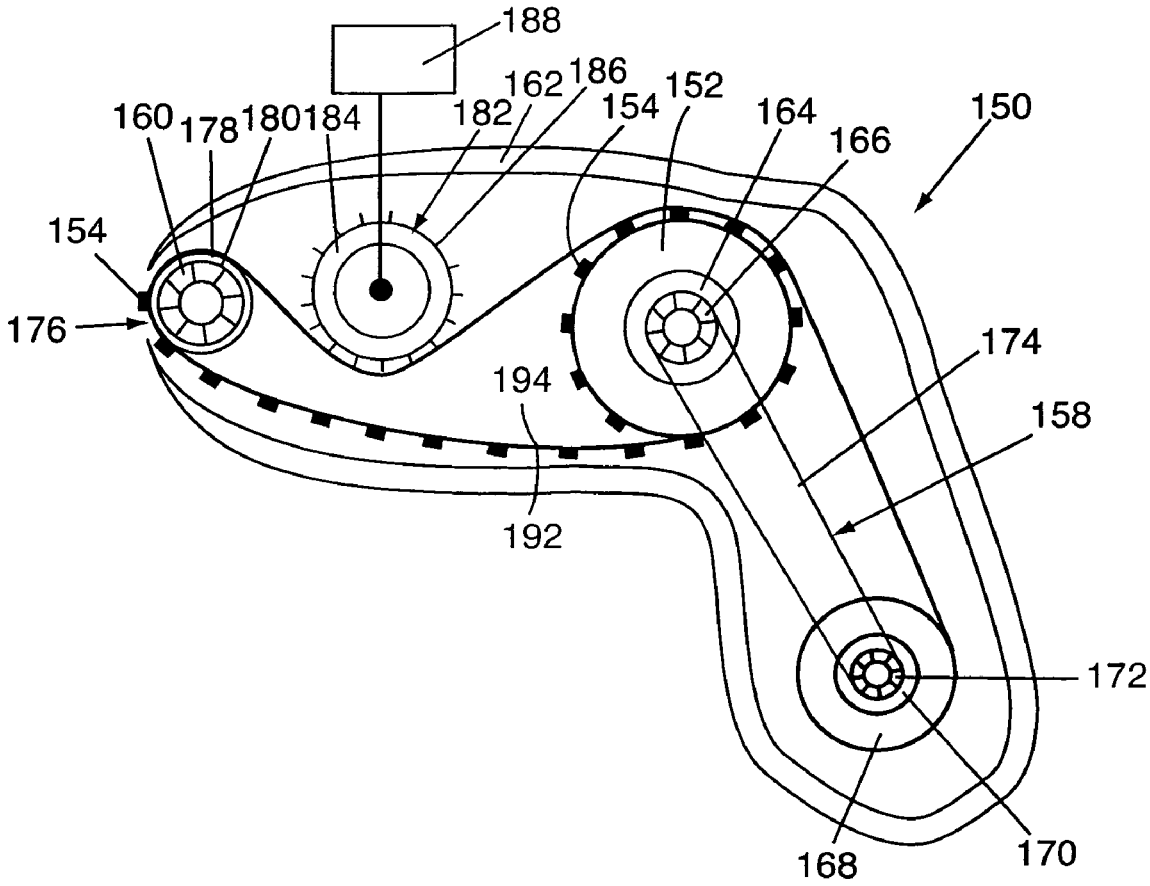
FIG. 20 is a side plan view of a second alternate embodiment of the adhesive segment applicator apparatus of the present invention.

FIG. 20 illustrates a second alternate embodiment of the adhesive segment applicator apparatus 150 of the present invention. In such embodiment, the adhesive segment applicator apparatus 150 also includes an automated advancement mechanism, indicated generally at 182, for advancing the indexed adhesive segment-laden carrier release tape 152 through the adhesive segment applicator apparatus 150. The advancement mechanism 182 includes a tape feed wheel 184 with a plurality of teeth 186 thereon. The teeth 186 are arranged and configured to interact with the indexed notches 156 of the indexed carrier release tape 152.

The advancement mechanism 182 includes an actuator 188 for automatically advancing the tape feed wheel 184 and the indexed adhesive segment-laden carrier release tape 152 through the adhesive segment applicator apparatus 150. The advancement mechanism 182 can include a motor or pneumatically driven power-automated actuator for use in an industrial or continuous processing applicator apparatus.

The adhesive segment applicator apparatus 150 of the present invention can be supported from a stand (not shown), with the application point on the adhesive segment applicator apparatus being oriented in a manner facilitating the application of a workpiece thereto to thereby apply adhesive segments to the workpiece. The stand allows the adhesive segment applicator apparatus 150 to be oriented in a variety of positions allowing the application point on the adhesive segment applicator apparatus 150 to be placed in a variety of orientations. Alternately, the adhesive segment applicator apparatus 150 and stand can be integrally manufactured, with the design of the adhesive segment applicator apparatus 150 facilitating variable orientations of the application point.

It may therefore be seen that the present invention teaches an adhesive segment applicator apparatus including an adhesive segment-laden carrier release tape that is always in a secure position, and is not permitted to come loose or pull away from the adhesive segment applicator apparatus. Indeed, the adhesive segment applicator apparatus of the present invention maintains proper tension on the adhesive segment-laden carrier release tape so that the adhesive segments are easily and efficiently removed from the carrier release tape.

It may also be seen that the adhesive segment applicator apparatus contains a self-advancing adhesive dispensing system including an adhesive dispensing wheel that permits automatic advancement of the adhesive segment-laden carrier release tape during application of an adhesive segment to a surface. In addition, it may be seen that the present invention provides a adhesive segment applicator apparatus that automatically winds the spent carrier release tape onto a roll—thereby reducing the problem of scrap carrier tape interfering with the adhesive application process.

It may also be seen that the adhesive segment applicator apparatus of the present invention may also include an advancement mechanism for use with carrier release tape having an indexing instrumentality, thereby allowing for an advancement mechanism to protrude therethrough for metering and advancement of the carrier release tape.

Although an exemplary embodiment of the adhesive segment applicator apparatus of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An adhesive segment dispensing apparatus, comprising:

(a) a housing comprising a main housing portion and a housing door pivotally secured to the main housing portion;

(b) a tape supply spool comprising a supporting core having a first end rotatably mounted directly on to the main housing portion of the housing and a second end spaced apart from the housing door;

(c) a roll of flexible carrier release tape removably positioned directly on to the supporting core of the tape supply spool, the roll of flexible carrier release tape extending longitudinally having a transverse width, opposed first and second release surfaces, and a plurality of adhesive segments arrayed non-contiguously in a longitudinally spaced-apart progression along the first release surface of the carrier release tape;

(d) a take-up spool comprising an accumulating core having a first end rotatably mounted to the main housing portion of the housing and a second end spaced apart from the housing door, the second end including a tape retainer mounted thereto, wherein the take up spool is spaced apart from the tape supply spool, receives an end of the flexible carrier release tape, and is coupled to the tape supply spool with a belt such that rotation of the tape supply spool drives rotation of the take-up spool, wherein the tape supply spool and the take-up spool rotate in the same direction; and (e) an adhesive dispensing wheel rotatably mounted to the main housing portion of the housing, such that the tape supply spool is located between the take-up spool and the adhesive dispensing wheel;

wherein the tape supply spool, take-up spool, and adhesive dispensing wheel are mounted with respect to each other within the main housing portion of the housing such that the flexible carrier release tape from the roll of flexible carrier release tape held on the supply spool is extended from the supply spool, around the adhesive dispensing wheel, and onto the take-up spool such that rotation of the supply spool to advance the carrier release tape to position an adhesive segment at the adhesive dispensing wheel to be applied to a work piece therefrom rotates the take-up spool to wind carrier release tape with the adhesive segments removed therefrom around the take-up spool.

2. The adhesive segment dispensing apparatus of claim 1 wherein the tape supply spool includes a tape supply spool drive pulley, wherein the take-up spool includes a take-up spool driven pulley, and wherein the take-up spool is coupled to the tape supply spool via the belt extending between the take-up spool driven pulley and the tape supply spool drive pulley.

3. The adhesive segment dispensing apparatus of claim 2 wherein the belt is mounted to the take-up spool driven pulley and the tape supply spool drive pulley so as to allow a limited amount of belt slip as rotation of the tape supply spool drives rotation of the take-up spool.

4. The adhesive segment dispensing apparatus of claim 2 wherein the tape supply spool drive pulley is formed integrally with the tape supply spool and wherein the take-up spool driven pulley is formed integrally with the take-up spool, and wherein the tape supply spool drive pulley and the take-up spool driven pulley are spaced apart from each other.

5. The adhesive segment dispensing apparatus of claim 1 wherein the adhesive dispensing wheel is mounted to the housing via a support structure extending from the housing.

6. The adhesive segment dispensing apparatus of claim 1 comprising additionally a tape guide wheel rotatably mounted to the main portion of housing between the tape supply spool and the adhesive dispensing wheel such that the flexible carrier release tape is extended from the supply spool over the tape guide wheel and around the adhesive dispensing wheel.

7. The adhesive segment dispensing apparatus of claim 6 wherein the adhesive dispensing wheel and the tape guide wheel are mounted to the housing via a support structure extending from the housing.

8. The adhesive segment dispensing apparatus of claim 1 wherein the tape supply spool, take-up spool, and adhesive dispensing wheel are mounted with respect to each other such that a flexible carrier release tape from a roll of flexible carrier release tape having the first release surface thereof with the adhesive segments arrayed thereon facing outward held on the supply spool is extended from the supply spool, around the adhesive dispensing wheel, over the first release surface of a portion of the roll of flexible carrier release tape held on the supply spool, and onto the take-up spool such that the portion of the carrier release tape extending between the adhesive dispensing wheel and the take-up spool is held in position by adhesive segments on the first release surface of the flexible carrier release tape on the roll of flexible carrier release tape.

* * * * *